US010072800B1

(12) United States Patent
Logan et al.

(10) Patent No.: US 10,072,800 B1
(45) Date of Patent: Sep. 11, 2018

(54) GRAPHICALLY REPRESENTING A CONDITION OF INFRASTRUCTURE

(71) Applicant: RedZone Robotics, Inc., Pittsburgh, PA (US)

(72) Inventors: Trevor Logan, Torbay (NZ); Richard Ashcroft, Meadowbank (NZ); Antony Van Iersel, Totara Vale (NZ); Michael Garnett, Whangaparaoa (NZ); Timothy Renton, Avondale (NZ); Grant Scogings, Albany Heights (NZ); Michael Langley, Farm Cove (NZ)

(73) Assignee: RedZone Robotics, Inc., Pittsburgh, PA (US)

( * ) Notice: Subject to any disclaimer, the term of this patent is extended or adjusted under 35 U.S.C. 154(b) by 142 days.

(21) Appl. No.: 13/654,376

(22) Filed: Oct. 17, 2012

Related U.S. Application Data

(60) Provisional application No. 61/547,920, filed on Oct. 17, 2011.

(51) Int. Cl.
*F17D 1/00* (2006.01)

(52) U.S. Cl.
CPC ..... *F17D 1/00* (2013.01)

(58) Field of Classification Search
CPC .... F17D 5/02; F17D 5/00; F17D 5/06; G01N 27/82; G01N 21/954; G01N 2291/044; G01N 2291/105; G01N 2291/2636; G01N 2291/2675; G01N 29/11; G01N 29/265; G01N 23/046
USPC ..... 702/34; 703/1, 9, 10; 73/592
See application file for complete search history.

(56) References Cited

U.S. PATENT DOCUMENTS

| | | | | |
|---|---|---|---|---|
| 7,414,395 | B2 * | 8/2008 | Gao et al. | 324/220 |
| 8,041,517 | B2 * | 10/2011 | Thayer et al. | 702/33 |
| 2010/0260402 | A1 * | 10/2010 | Axelsson et al. | 382/131 |
| 2010/0329532 | A1 * | 12/2010 | Masuda et al. | 382/132 |

OTHER PUBLICATIONS

Rizzo, Water and Wastewater Pipe Nondestructive Evaluation and Health Monitoring: A Review, Hindawi Publishing Corporation Advances in Civil Engineering vol. 2010, Article ID 818597, 13 pages.*

RedZone Robotics, MSI Sample Specification—MSI v1.0, 2009.*

Limon-Tapia, S., Assessing Pipeline Integrity: In-Line Inspection Technologies and Capabilities, Washingtion State Citizens Committee on Pipeline Safety, Sep. 14, 2011.*

Jackson, Nondestructive Testing of Water Mains for Physical Integrity [Project #507] http://www.waterrf.org/ExecutiveSummaryLibrary/90601_507_profile.pdf.*

RedZone/ICOM3, Solo Robot and ICOM3 Software Pilot, Presentation for Dallas Water Utilities City of Dallas, Aug. 2, 2010.*

(Continued)

*Primary Examiner* — Brian S Cook
(74) *Attorney, Agent, or Firm* — Cafardi, Ferguson, Wyrick, Weis + Stotler LLC; Andrew M. Gabriel

(57) ABSTRACT

One aspect provides a method including: receiving fluid conveyance infrastructure data at an electronic device; determining variance data for an infrastructure segment by comparing the received fluid conveyance infrastructure data to expected fluid conveyance infrastructure data; and providing at least one distribution based graphical representation based on the variance data. Other aspects are described and claimed.

12 Claims, 19 Drawing Sheets

(56) References Cited

OTHER PUBLICATIONS

SewerVUE, News Release—Mar. 2010, http://sewervue.com/news-events/pages/2/.*
TACWA Meeting Minutes, Dallas, Texas Jul. 30, 2010 9:00AM.*
Beason, RedZone/ICOM3, Solo Robot and ICOM3 Software Pilot, Presentation for Dallas Water Utilities City of Dallas, Aug. 2, 2010.*
Logan, B.F., Shepp, L.A., The Fourier Reconstruction of a Head Section, IEEE Transactions on Nuclear Science, vol. NS-21, Jun. 1974.*
Beason, M.D., RedZone/ICOM3 Solo Robot and ICOM3 Software Pilot for: Dallas Water Utilities City of Dallas, RedZone Robotics Presented Jul. 30, 2010 Downloaded from http://www.tacwa.org/images/RedZone_Robotics- ICOM3_for_City_of_Dallas.pdf.*
Coker, J. D., Signal Processing Algorithms for Simplified-Hardware Multistatic Synthetic Aperture Radar, University of Minisota, Oct. 2008.*
IAEA, Training Course Series No. 17, Guidebook on non-destructive testing of concrete structures, International Atomic Energy Agency, Vienna, 2002.*
Abe, H., An Inverse Problem in Non-Destructive Inspection of a Crack in a Hollow Cylinder by Means of Electrical Potential Method, S. N. Atluri et al. (eds.), Computational Mechanics 1988, Springer-Verlag Berlin Heidelberg, 1988.*
Olafsson, G., (eds.), The Radon Transform Inverse Problems, and Tomography, American Mathematical Society Short Course, Jan. 3-4, 2005, Atlanta, Georgia.*
Martin_2007 (Using Historical Repair Data to Create Customized Predictive Failure Curves for Sewer Pipe Risk Modeling, LESAM 2007—2nd Leading Edge Conference on Strategic Asset Management Lisbon, Portugal. Oct. 10-17, 2007).*
Coker_2008 (Signal Processing Algorithms for Simplified-Hardware Multistatic Synthetic Aperture Radar, Oct. 2008).*
IAEA_2005 (Development of Protocols for corrosion and deposits evaluation in pipes by radiography, IAEA-TECDOC-1445, Vienna, Apr. 2005).*
Betamike_2003 (Precision Measurement & Control Systems for Plastic Pipe; BETA LaserMIKE, Jun. 4, 2003 downloaded from www.betalasermike.com/beta-lasermike-downloads/plasticpipe.pdf).*
Standards_2006 (Role of Standards: A guide for small and medium-sized enterprises, United Nations Industrial Development Organization, Vienna, 2006).*
Day_2005 (Process Capable Tolerancing, Tec-Ease Inc, USA, Mar. 3, 2005).*
Pipe_Wallmast2007 (Wallmaster OD/ID/WALL measuring and control systems for pipe, Zumbach, Oct. 2007).*
Beason (RedZone/ICOM3, Solo Robot and ICOM2 Software Pilot, Aug. 2, 2010).*
Betamike_2003 (Precision Measurement & Control Systems for Plastic Pipe; BETA LaserMIKE, Jun 4, 2003 downloaded from www.betalasermike.com/beta-lasermike-downloads/plasticpipe.pdf).*
Usys_2005 (Monitoring, Data Control, Acquisition and Display for Single and Multi Sensor Applications, Zumbach Nov. 2005).*

* cited by examiner

BINS - 0-100% WALL LOSS

GRAPHICALLY REPRESENTING A CONDITION OF INFRASTRUCTURE

CROSS REFERENCE TO RELATED APPLICATION

This application claims priority to U.S. Provisional Patent Application Ser. No. 61/547,920, entitled "SYSTEM AND METHOD FOR GRAPHICALLY REPRESENTING A CONDITION OF A PIPE", filed on Oct. 17, 2011, the contents of which are incorporated by reference in their entirety herein.

FIELD

The subject matter described herein generally relates to providing graphical representations of a condition of infrastructure.

BACKGROUND

There are many contexts in which a condition of a pipe is of importance. For example, every year, wastewater managers must make decisions about which portions of their collection system should be maintained, rehabilitated or replaced. The Environmental Protection Agency (EPA) and American Society of Civil Engineers (ASCE) both project hundreds of billions of dollars of investment shortfalls facing aging wastewater infrastructure. Thus, it is important that wastewater managers are able to spend their limited funds most wisely to reduce risks and maintain service levels at a low cost.

In the example context of managing a municipal wastewater collection system, a wastewater manager faced with a limited budget makes prioritization and investment decisions based on the best information available at the time. Unfortunately, this information is often incomplete and inconclusive at best. This is due to lack of adequate technology for providing accurate representations of the condition of the pipe sections making up the collection system. Closed-circuit television (CCTV) is currently the primary technology used for assessing pipe condition, which is a qualitative tool that captures video images from inside pipes.

BRIEF SUMMARY

In summary, one aspect provides a method comprising: receiving fluid conveyance infrastructure data at an electronic device; determining variance data for an infrastructure segment by comparing the received fluid conveyance infrastructure data to expected fluid conveyance infrastructure data; and providing at least one distribution based graphical representation based on the variance data.

Another aspect provides a method comprising: receiving fluid conveyance infrastructure data at an electronic device; determining features of a fluid conveyance infrastructure segment using the fluid conveyance infrastructure data; providing at least one flat graph representation based on the variance data; and providing at least one visual presentation matched to the at least one flat graph representation.

A further aspect provides a method comprising: receiving fluid conveyance infrastructure data at an electronic device; determining variance data for an infrastructure segment by comparing the received fluid conveyance infrastructure data to expected fluid conveyance infrastructure data; comparing the variance data to one or more sets of previously determined variance data; and providing an estimate of infrastructure asset future condition based on the comparing.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
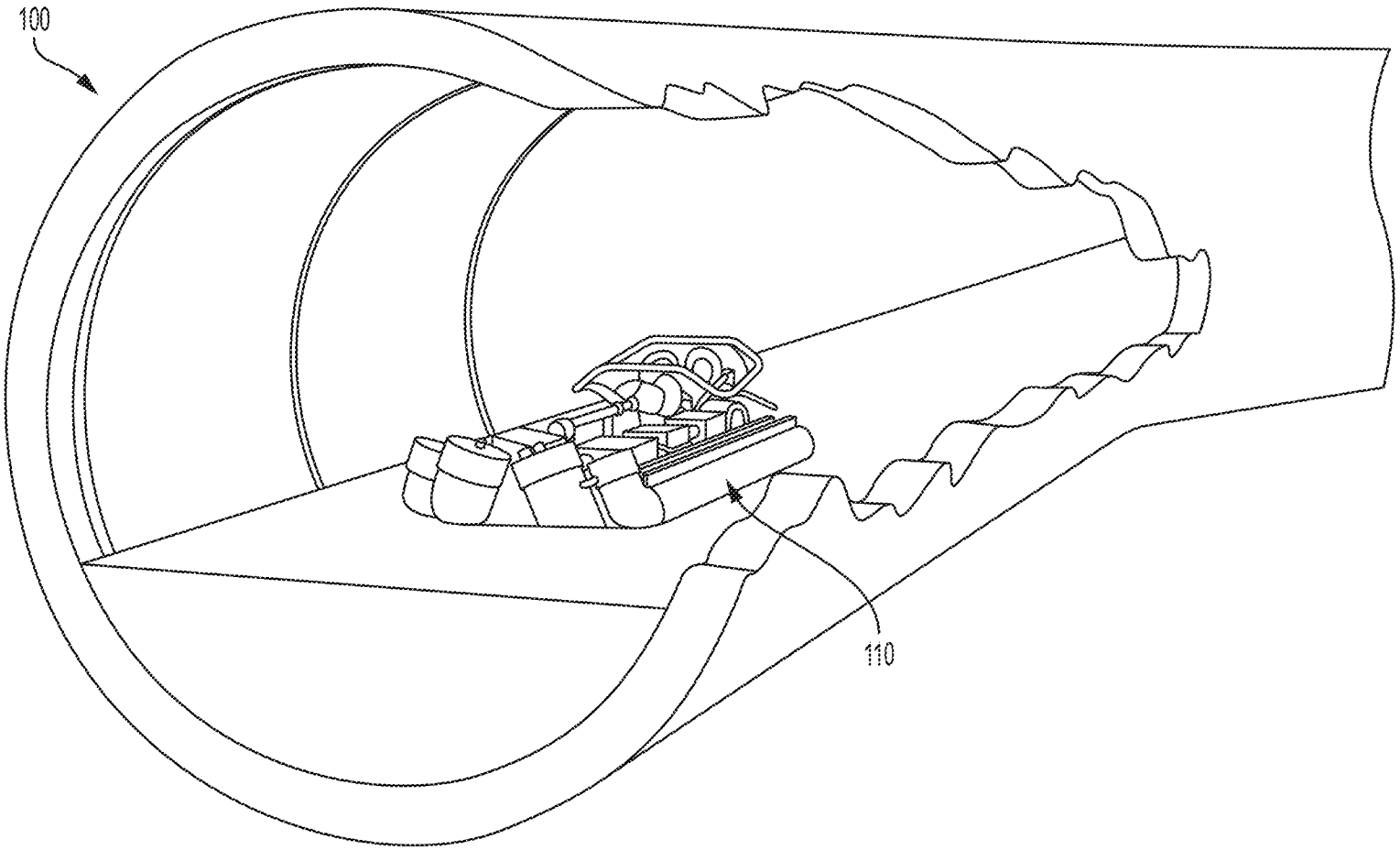
FIG. 1 illustrates an example pipe inspection robot in a pipe segment.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the claims, but is merely representative of those embodiments.

Reference throughout this specification to "embodiment(s)" (or the like) means that a particular feature, structure, or characteristic described in connection with the embodiment is included in at least one embodiment. Thus, appearances of the phrases "according to embodiments" or "an embodiment" (or the like) in various places throughout this specification are not necessarily all referring to the same embodiment.

Furthermore, the described features, structures, or characteristics may be combined in any suitable manner in one or more embodiments. In the following description, numerous specific details are provided to give a thorough understanding of example embodiments. One skilled in the relevant art will recognize, however, that aspects can be practiced without one or more of the specific details, or with other methods, components, materials, et cetera. In other instances, well-known structures, materials, or operations are not shown or described in detail to avoid obfuscation.

Especially in critical large-diameter trunks and interceptors, visual-only inspection of pipes, such as using CCTV, is often unreliable and leaves decision-makers with the tough task of evaluating which pipes might be deteriorating. With costly rehab decisions at stake, wastewater managers need facts on infrastructure condition, for example corrosion severity, not just visual evidence of potential problems.

Embodiments provide tools that complement CCTV inspections and provide wastewater managers (or others with a need to know the condition of a pipe) with objective, reliable measurements that are presented in useful, intuitive and easily understood formats. In terms of data collection, embodiments provide multi-sensor collection of pipe condition data. For example, in addition to CCTV data, embodiments may employ laser and sonar based scanning, which precisely measures a pipeline's size, shape, water loss, water level, sediment build up, alignment, cross sectional dimensions, longitudinal dimensions, 3-D shape, structural deformation, level of corrosion, or the like, and/or other sensors, such as passive sensors for measuring gas levels, sensors for measuring inclination, sensors for measuring sound, etc. These quantitative measurements characterize infrastructure condition, for example corrosion deterioration, identify deformation ("ovality"), etc., and allow decision-makers to objectively benchmark portions of the collection system for prioritization of repairs or replacement. Over time, these measurements can provide a calculated rate of deterioration so managers can understand where and how problems are developing. In addition, embodiments may employ laser or other technologies to generate color-coded 2D and 3D models or graphical representations to visually show problem areas in an easy-to-understand format. The graphical representations may include representations derived from additional or alternative data sources, for example contextual data indicating rain events, time of day (when measurements were obtained), and the like, and be included within a graphical representation, as further described herein.

Embodiments thus provide graphical representations of the condition of a pipe, allowing wastewater managers to base their decisions on objective and quantitative information rather than poring over videos and photos to deduce which areas might be suffering from the worst problems. Embodiments provide temporal comparisons and calculations that may be used over multiple years, permitting informed decisions based on a rate of deterioration and fact-based estimations of remaining useful life. Accordingly, embodiments provide wastewater managers with objective information to take the guesswork out of pipe condition assessment. With limited funds, this information allows wastewater managers to most wisely oversee infrastructure management.

The description now turns to the figures. The illustrated example embodiments will be best understood by reference to the figures. The following description is intended only by way of example and simply illustrates certain selected example embodiments representative of the invention, as claimed. It should be noted that although wastewater pipes are specifically mentioned as examples herein, the various embodiments may be employed in other pipe segments.

Referring generally to FIG. 1, an example data acquisition platform 110 is illustrated as situated within an example pipe cross section 100. The data acquisition platform 110 may be a modular combination of various hardware and software components, selected for example based on a given implementation. The data acquisition platform 110 thus may utilize any of a plurality of different architectures. For example, the illustrated example data acquisition platform 110 of FIG. 1 is a data acquisition platform including a floating mobility component with sensors (e.g. a laser sensor module and associated cameras) mounted thereon, with additional sensors (e.g. a sonar component) positioned to monitor infrastructure characteristics below the floating platform, for example as found in the HD PROFILER SYSTEM, available from REDZONE ROBOTICS of Pittsburgh, Pa. According to various embodiments, the data acquisition platform 110 may also take the form of a pipe inspection robot utilizing an architecture similar to that disclosed in U.S. patent application Ser. No. 12/611,641, the contents of which are incorporated by reference herein. Accordingly, an example data acquisition platform 110 is used throughout this description and may be referred to as a pipe inspection robot; however, it will be understood that the various embodiments are not limited to the example data acquisition platforms described explicitly herein, and that other data acquisition platforms may be utilized without departing from the scope or spirit of the described embodiments.

Additionally, any of a plurality of different methods may be utilized to deploy a data acquisition platform 110, retrieve a data acquisition platform 110, acquire infrastructure data collected by a data acquisition platform 110, monitor a data acquisition platform 110, and/or analyze, organize, and/or utilize the infrastructure data, as further described herein.

Underground infrastructure, represented illustratively by example pipe cross-section 100 in FIG. 1, involves the need to access and collect data in a variety of structures. In this regard, as used herein the terms "fluid conveyance infrastructure" or simply "infrastructure", have the meaning of water and/or sewer physical infrastructure, including pipes, manholes, laterals, access shafts, junction chambers, valve chambers, and treatment structures.

Accordingly, the example data acquisition platform 110 is configured to use a single hardware platform that accommodates as many different structural contexts as possible. The data acquisition formats are predominately the same (between various infrastructure contexts), thus allowing for common data acquisition methods to be employed, irrespective of the exact structural context encountered or the particular data acquisition platform 110 selected for data collection.

In some embodiments, a data acquisition platform 110 may be pre-loaded or pre-programmed with one or more missions to perform data collection. The data collection may be performed serially or in parallel. Data collected by the data acquisition platform 110 may be stored locally or transmitted to another device or devices for storage and analysis, or a suitable combination of the foregoing. The data acquisition platform 110 may be synchronized to a device on a network, for example via wireless communication using a cellular modem. Data may be uploaded to another device using a network connection as well. The data uploading or synchronization may be conducted periodically, intermittently, on a schedule (e.g. time or location based), may be triggered by transmitting a signal to the data acquisition platform 110 over a network, or a suitable combination of the foregoing.

The data acquisition platform 110 may include a plurality of sensors for collecting infrastructure data, including for example pipe condition data and related data, such as positioning information of the data acquisition platform 110 within a pipe system. The plurality of sensors may include but are not limited to a camera for capturing CCTV video or still images, laser based technology for acquiring dimensional measurements of the pipe (in 360 degrees), sonar for acquiring dimensional measurements under a fluid (e.g. wastewater), or a suitable combination of the foregoing. More or fewer sensors may be included with and utilized by the data acquisition platform 110 depending on the desired data collection.

For example, the data acquisition platform 110 may sense and/or receive infrastructure data via active or passive means, e.g. collecting data via laser based technology and/or sonar based technology to scan and record data relevant to surface features of the internal pipe, for example cross section of pipe 100, or receive data such as sound data, gas level data or the like. The laser and sonar modules of data acquisition platform 110 may emit light or sound waves, respectively, and collect reflection data. The reflection data may then be stored or transmitted by the data acquisition platform 110 for analysis along with other data, such as CCTV data, location data. Additionally, the data acquisition platform 110 may collect data emitted by the environment, such as sound measurements, gas measurements or similar. Collectively all the data collected by the data acquisition platform 110 may be referred to herein as sensed data. By virtue of the time and location of sensed data, other data such as rain events, proximity to water bodies etc. may be referenced from other sources or databases, such as a Geographical Information System (GIS) and associated to the sensed data. Collectively all the data secured from sources other than the data acquisition platform 110 and associated to the sensed data based on the time and location will be referred to herein as contextual data.

The 2D and 3D visual representations will be referred to herein as visual representation data or cross section data. The visual representation data or cross section data thus may include sensed data collected via sensors of the data acquisition platform 110 and synchronized (in terms of location and time) with positioning and timing data for analysis. Using this sensed data collected by the data acquisition platform 110, variations in relevant parameters, for example pipe diameter, may be determined by comparison with known pipe dimensions (e.g. original dimensions or previously measured dimensions). Thus, the sensed data may be used to determine variance data, which in turn may be processed to provide graphical representations of the condition of the pipe or infrastructure of interest.

Thus, accordingly to embodiments, the sensed data may be collected to offer a visual representation of the condition of a length or segment of pipe. The visual representation formed from the data collected by the data acquisition platform 110 may be for a given length or segment of pipe, such as 1 meter of pipe, or for a larger segment of pipe (for example between two manholes), or may be for an entire pipe network. For example, the data acquisition platform 110 may collect sensed data from laser and/or sonar sensors and synchronize this collected data with a given section location of pipe. The sensed data may then be processed to form a two dimensional (2D) or three dimensional (3D) representation of the condition of the pipe, may be provided as a numerical representation (e.g. statistical summary, such as a mean pipe sediment value), or the like, as further described herein.

The sensed data may be processed in a variety of ways to provide useful presentation of the data representing the condition of a pipe. An example process begins with cross sectional data gathered during inspections of pipelines using a data acquisition platform 110 (more than one may be deployed in a given pipe or network of pipes). According to various embodiments, a cross section may be collected approximately every 10 millimeters, although shorter intervals can be used.

The data acquisition platform 110 then digitizes the cross-section by 180 radial measurements to give a circumferential representation of the pipeline, more or less radial measurements could be used by various embodiments. This digitizing step, along with all other data processing steps may be performed on-board the data acquisition platform 110, at a remote device receiving sensed data (or visual representation data), or a combination of the foregoing. The cross sectional data may be visually overlaid with the (known) original pipeline shape (or previously measured pipe shape, a comparison pipe shape obtained from cross-reference data, or the like) and the variance data from this reference is ascertained.

Figure 2:
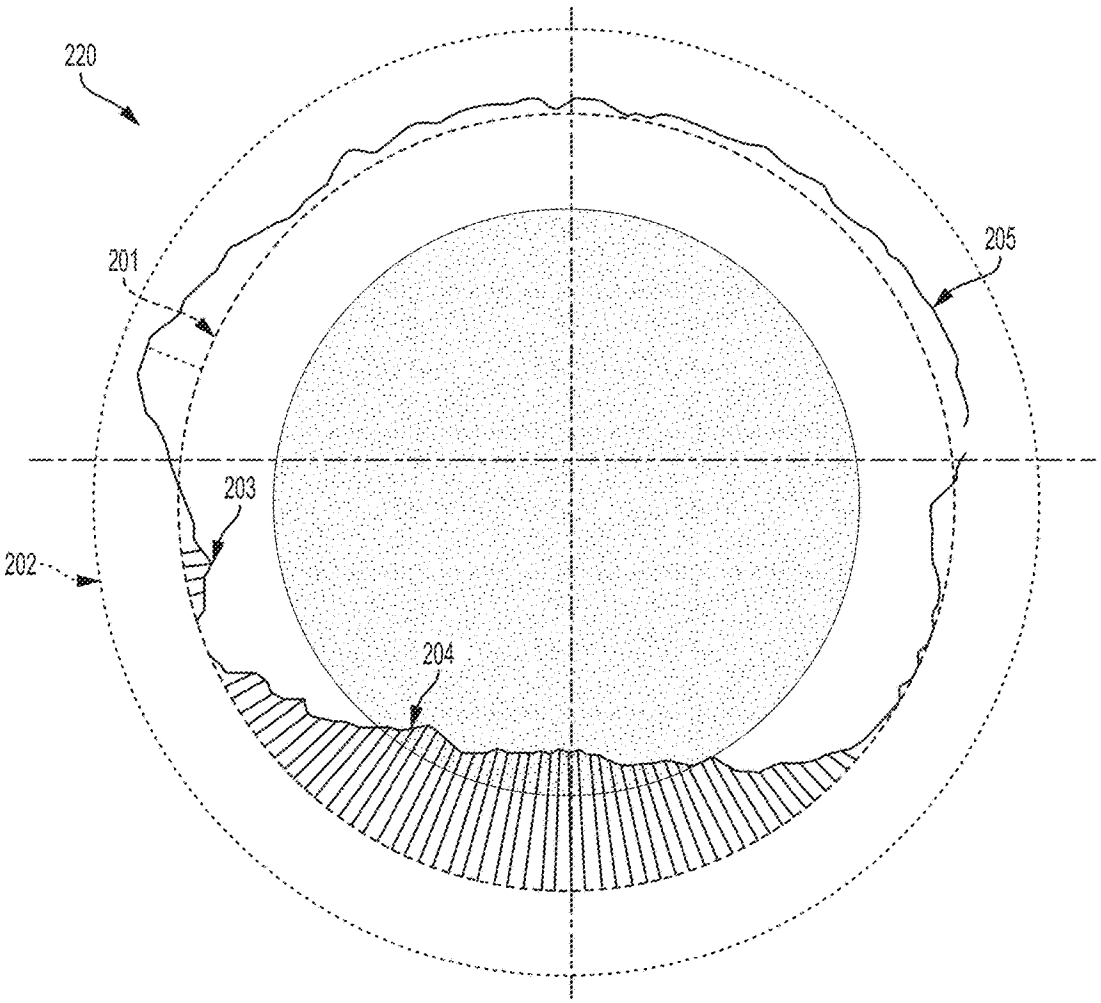
FIG. 2 illustrates an example pipe cross-section.

An example of a cross-section of an example pipe overlaid with the original pipeline is shown in FIG. 2. The pipe cross-section 220 includes the original pipe shape inner diameter 201 and outer diameter 202. Over time, the pipe 220 may accumulate buildup 203, sediment 204 or suffer corrosion 205, each of which changes the diameter of the pipe cross-section 220. The system (the data acquisition platform 110, a remote device, or a combination thereof) may then determine a selected proportion (for example 20%) of the 180 points (but not limited to 180 points) collected for the segment of pipe 220 that are furthest outside the reference shape 201. The points are each grouped into "bins" of the percentage wall thickness they represent. For example, a point one quarter of a wall thickness outside the ideal reference would be placed in the 25% bin. The number of points in each bin is then converted into a percentage of the total for that cross section. The points may vary from the original diameter because they show increased diameter (e.g. due to erosion, corrosion or change in ovality), a decrease in wall thickness and a positive variance; or they may show decreased diameter (e.g. due to debris/build up or change in ovality), an increased wall thickness and a negative variance.

Figure 3:
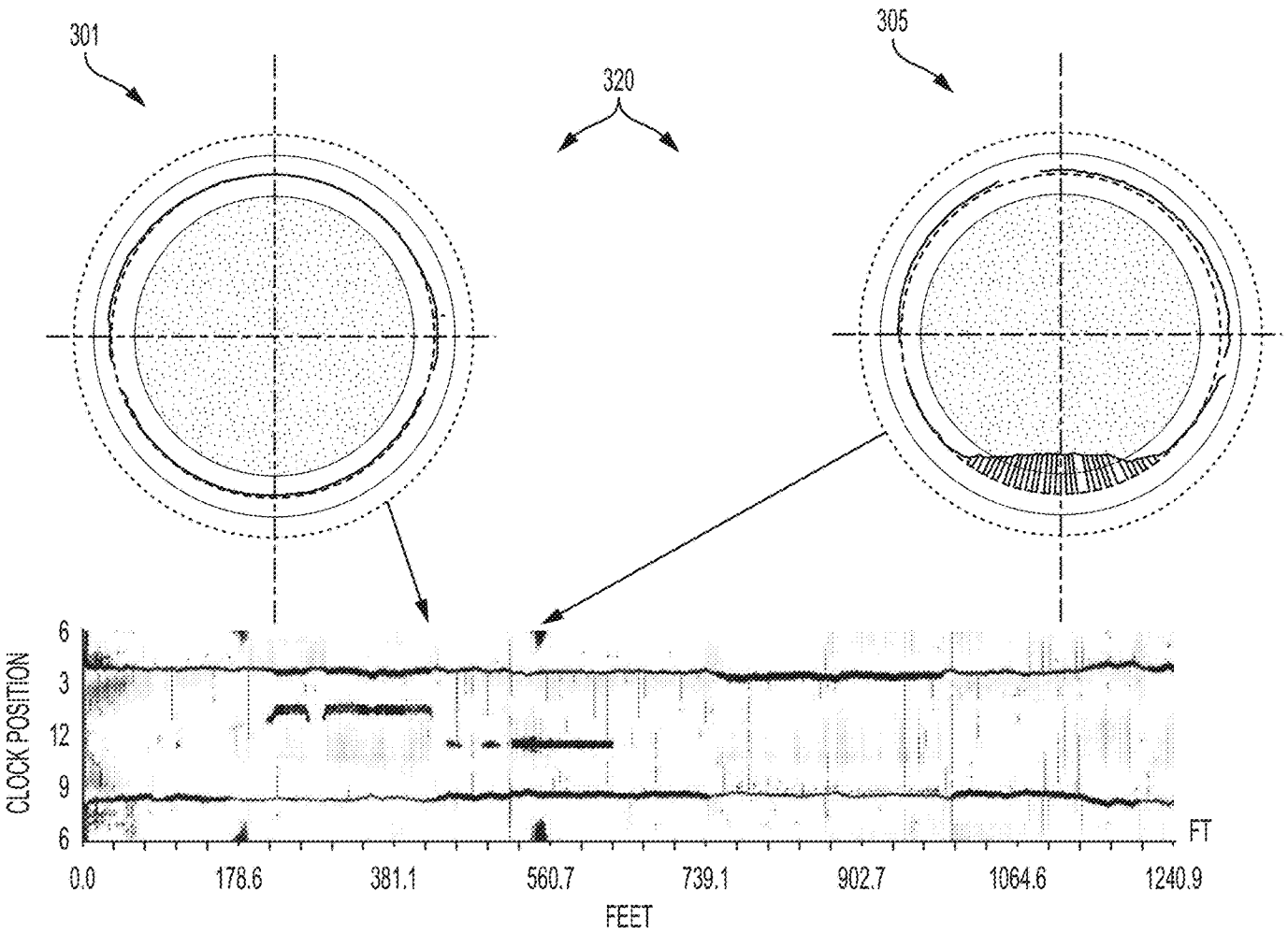
FIG. 3 illustrates example 2D graphical representations of conditions of pipe segments.

Illustrated in FIG. 3, the diameter of the pipe cross-section 320 may change from an initial condition due to the pipe experiencing sediment build up or corrosion of the pipe cross section 320. No matter the source of the change in pipe cross-section 320, the sensed data will accurately represent the changes (e.g. down to 1 millimeter). In FIG. 3, the left view 301 illustrates a pipe cross section for a point in the segment of pipe at between 33.3 meters and 26.5 meters. This segment of pipe 301 has not experienced significant change, as represented by the cross-sectional representation and as reflected in the flat graph (lower panel). In contrast, on the right of FIG. 3 the pipe segment 305 at a point between 6.3 meters and 0.0 meters has experienced significant change in its cross sectional shape, as represented by the graphical cross sectional representation and as reflected in the flat graph (lower panel).

No matter the source of the change in cross-sectional shape, the determination of change from the known shape, the grouping and the converting then may be repeated for each frame or segment in a section of the pipe (for example a 1 meter section), giving an average percentage for each bin over that 1 meter section of pipe. The determination of change from the known original shape, the grouping and the converting then may be repeated (in this example) for each 1 meter section of the pipe for a given section of pipe, giving an array of average percentage for each bin and pipe section. The system calculates the largest bin and standard deviation from this data. The same process then may be applied to those points that are furthest inside the reference shape (to account for debris/build up/change in ovality).

Figure 4A:
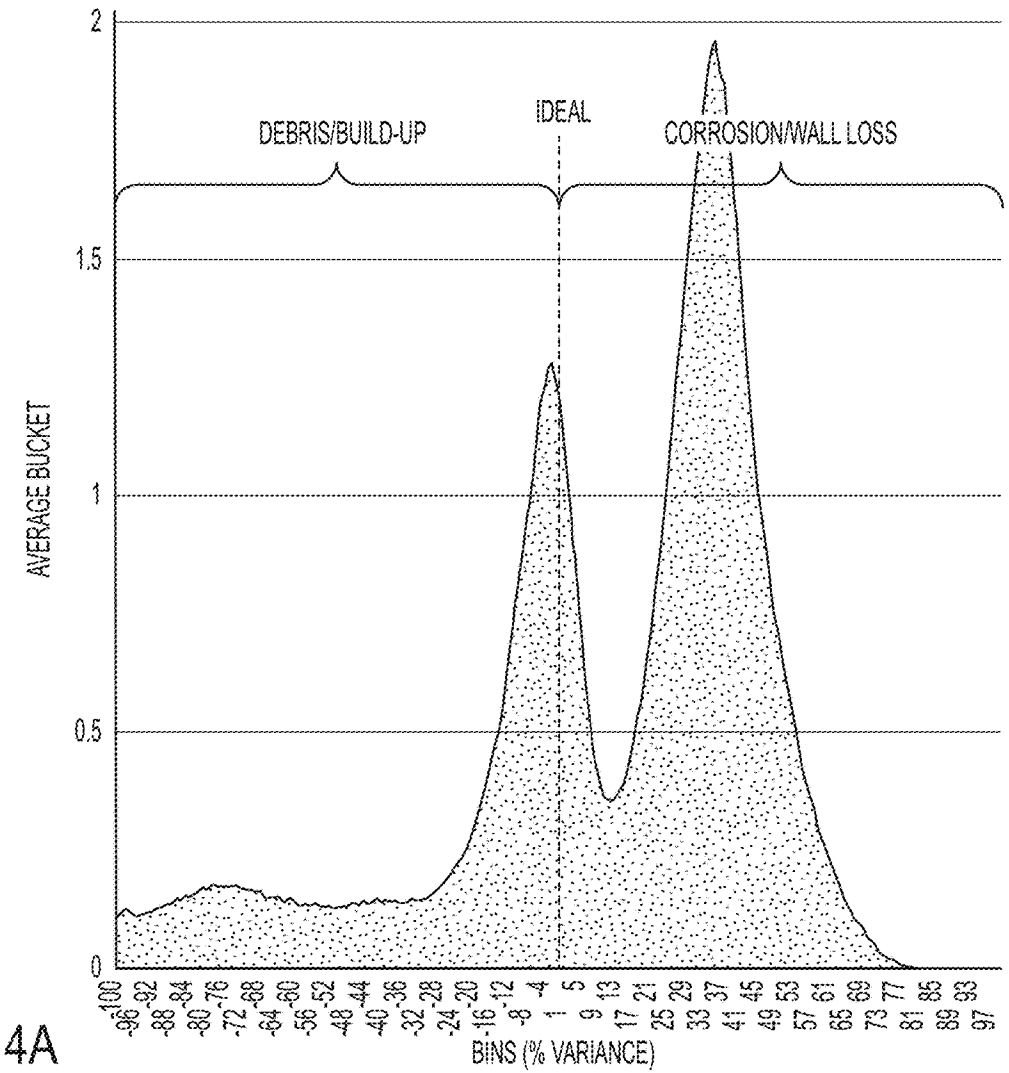
FIG. 4A illustrates an example Logan Distribution of a pipe segment.

Once the variances have been determined, the system utilizes the dataset to generate a graph referred to herein as the Logan Distribution, which is a distribution based graphical representation. An example bin distribution is illustrated in FIG. 4A for a section of concrete pipe. As shown, for this section of pipe, the variance data indicate that the pipe has undergone some corrosion/wear, whereas the pipe has accumulated more debris/build up. This is reflected by the distribution of more points falling into positive variance bins (less wall thickness/larger pipe dimension) than negative variance points (greater wall thickness/smaller pipe dimension).

Accordingly, an embodiment can use the Logan Distribution to show variance from the reference shape throughout the pipeline. As illustrated in FIG. 4A, the average number of points in each bin is plotted against the bin. This makes it easy to see the distribution of percentage variance from the reference. For example, a graph with a peak at around 5% variance indicates a pipeline in good condition, while a peak centered at higher percentages (positive or negative) is progressively worse.

Figure 4B:
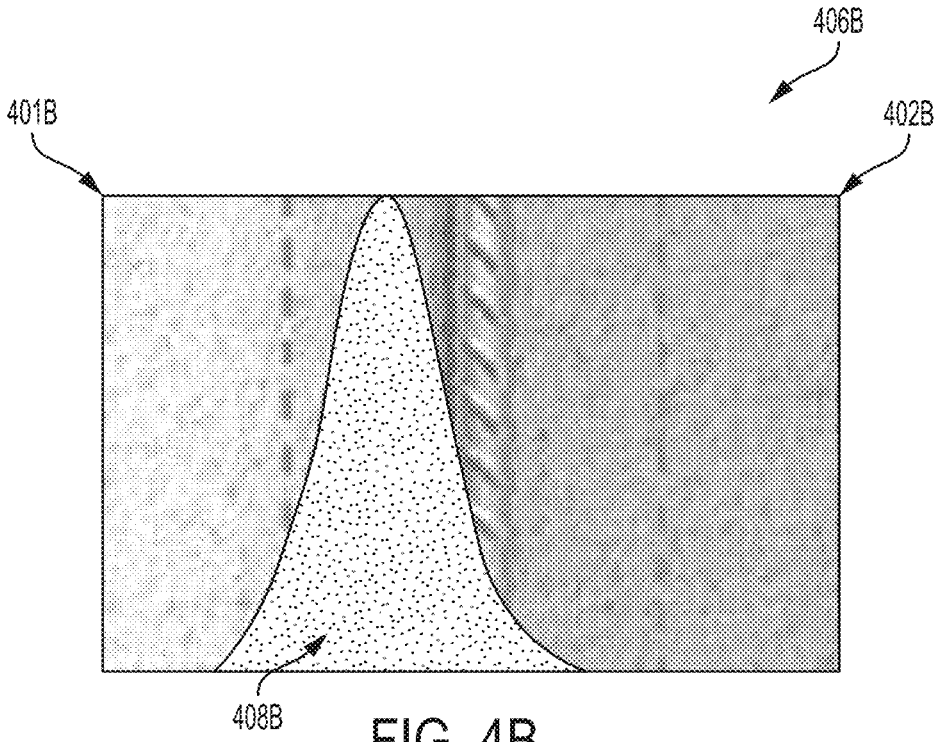
FIG. 4B illustrates an example Logan Distribution superimposed on an example graphic representation of a pipe wall.

In FIG. 4B a Logan Distribution is illustrated as mapped onto a pipe wall cross-section by an embodiment. The Logan Distribution 408B may be mapped onto a graphic 406B, here a pipe wall including an interior wall face 401B, and the exterior wall face 402B. An embodiment provides a graphic representation 406B of the pipe wall and the Logan Distribution for a particular pipe segment of interest (e.g. a particular 1 meter segment). For a corrosion Logan Distribution, for example, different pipe wall loss thresholds may indicate when a certain rehabilitation procedure (e.g. replacement) should be applied.

Figure 4C:
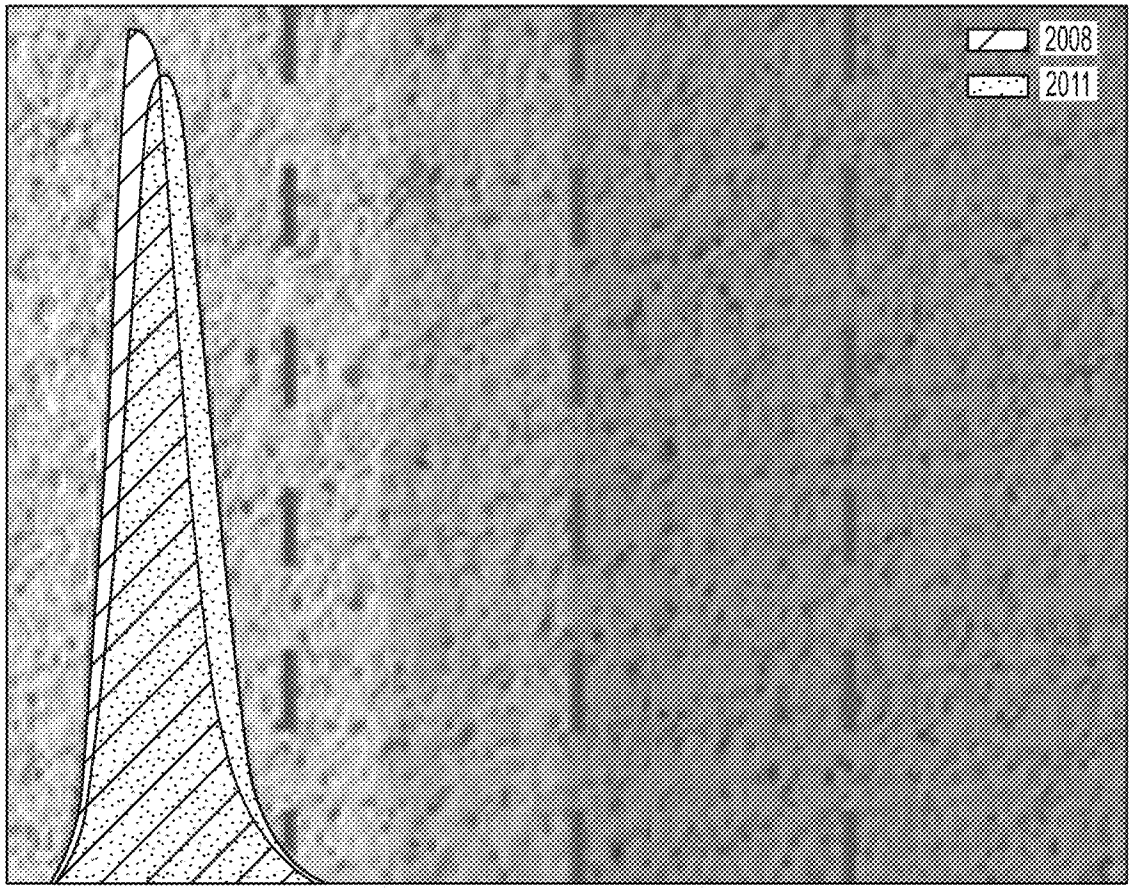
FIG. 4C illustrates two example Logan Distributions over time and superimposed on a graphic representation of a pipe wall.

An embodiment may keep historical data in order to provide a representation of change in a particular pipe segment over time. As illustrated in FIG. 4C, for a given pipe segment measured in 2009 and 2011, the Logan Distribution has changed. A comparison of Logan Distributions for a given pipe at two different periods of time indicates, in the leftmost distribution (for 2009) and the rightmost distribution (for 2011), the peak has moved slightly right and dropped, indicative of more corrosion with the passage of time. Comparing Logan distributions of the same asset over time indicates that more portions of the pipe are more corroded when the same pipe was inspected 2 years after the initial inspection. This is intuitive since corrosion wall loss occurs progressively over time. Such a time based comparison to the same asset (pipe segments) over time allows for predicting how a pipe system will fair over time.

Figure 4D:
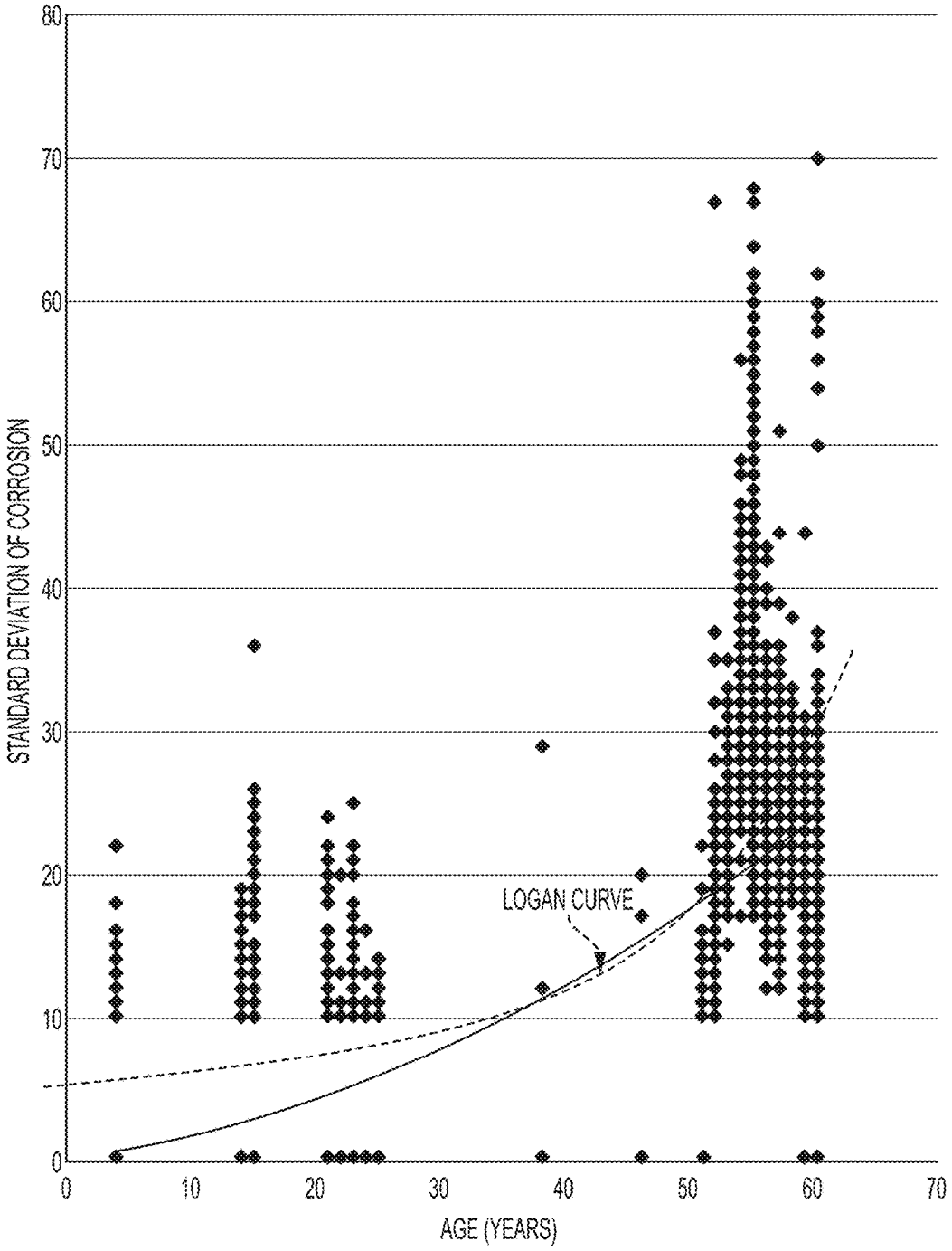
FIG. 4D illustrates an example Logan Curve for a network of pipe segments.

For example, illustrated in FIG. 4D, an embodiment can use a Logan Curve to show the condition of a pipe system plotted against its age. Using the same dataset as the Logan Distribution, the standard deviation of the points in each 1 meter section may be plotted against the age of the pipe in years. This may be done for an entire network of pipes. An example of a Logan Curve for a network of pipes is shown in FIG. 4D. By adding a best fit trend line incepting at zero, the Logan Curve shows the gradual deterioration of all pipes of various ages over time.

Given a Logan Curve, as illustrated in FIG. 4D, an embodiment may take new infrastructure data, such as a new pipe data segment, determine the corrosion (in the example of FIG. 4D) and plot the data on the Logan Curve. This allows an embodiment to ascertain if the newly measured data matches the expected trend of the Logan Curve. If not, the newly measured data may be used to give an updated estimate of pipe corrosion. For example, if pipe corrosion data for a 40 year old pipe indicates that it has corrosion (according to the Logan Curve for the network) of a 60 year old pipe, this particular pipe may be determined to be corroding faster, and thus its life expectancy can be updated accordingly.

An embodiment may also use this data to derive a rate of corrosion (or other measured parameter) used in a remaining useful life calculation. Given a dataset with multiple pipe assets, a scatter-plot (FIG. 4D) may be generated plotting the age of each pipeline asset against its Logan Distribution corrosion level. A best fit curve can be generated that establishes a quantitative relationship between age of pipe and corrosion level, which can be interpreted as a rate of corrosion. This best fit curve could be a linear deterioration, or some other curve modeling in accelerating or decelerating corrosion (or other parameter) over time.

The Logan Curve also allows the current range of ages of pipelines in a network to be used by an embodiment to estimate the age at which the pipes will reach a certain level of degradation. By corresponding levels of deterioration with appropriate repair actions, the cost and recommended course of action can be generated and presented. An embodiment can utilize this information to make calculations estimating the potential savings by expediting repairs. Furthermore, the effect (degree of leveling) on the trend line of spending various amounts of money on maintenance can be generated and presented.

Figure 5:
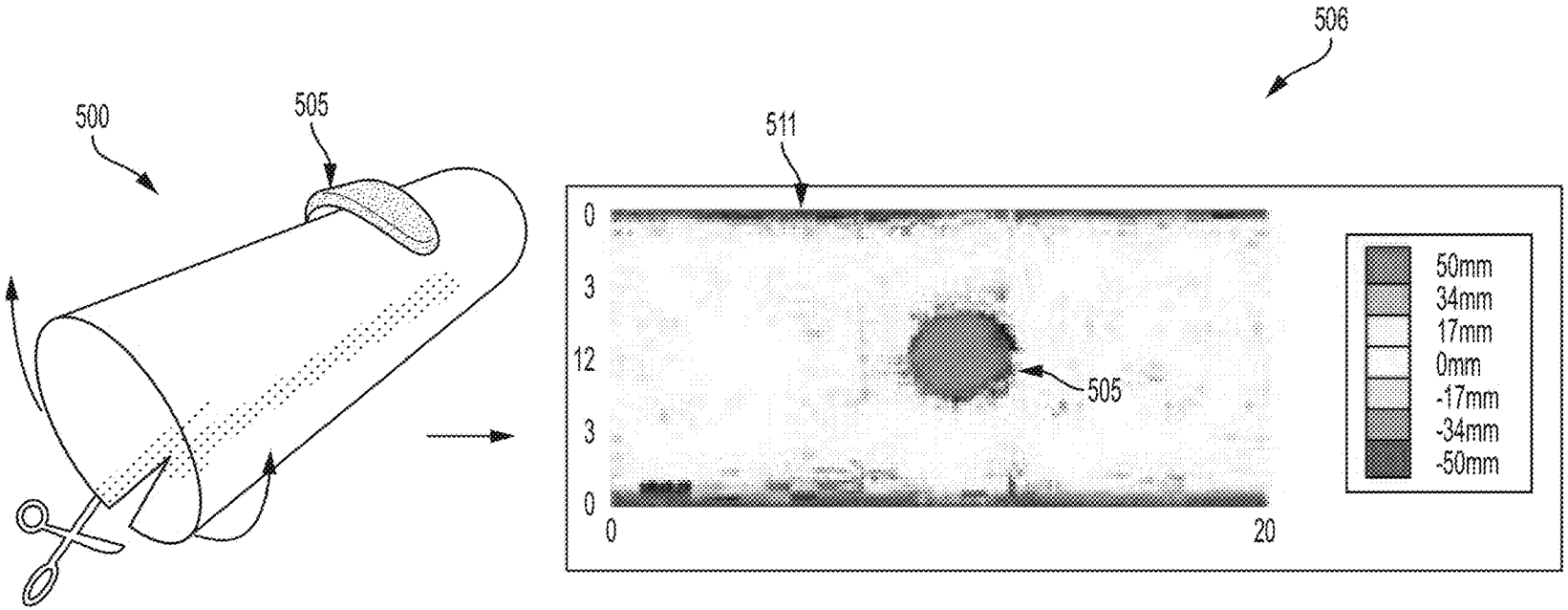
FIG. 5 illustrates an example process for forming a flat graph.

As illustrated in FIG. 5, an embodiment may use the precise measurements of the condition of a pipe segment to provide machine vision, including 2D and 3D representations of the condition of a pipe. An embodiment may use machine vision to find where in a corresponding video image (e.g. a CCTV image capture by the data acquisition platform 110) exits. Each frame of inspection video may be analyzed to build a digital profile of the pipe. From this profile, a variety of displays may be provided.

Thus, a particular pipe segment profile 500 may be represented in 2D, as if the pipe segment had been cut lengthwise along the base of the pipe, then pulled apart and flattened, i.e. a flat graph 511. Anomalies in the pipe profile 500, for example measurements indicating corrosion 505, may be translated into the 2D flat graph 511, and color coded, such that the user is provided with a 2D representation of the anomaly 505. A measurement index (e.g. topographic scale coding millimeters of wall thickness into colors matched to the flat graph 511) may be included for quick reference and review of a segment of pipe represented by the flat graph 511. The 3D nature of the pipe profile 500, including anomaly 505, thus may be represented by the flat graph 511 in topographic format, including upper and lower edges coded to show sediment build up (along the "cut" line in the illustrated example).

Figure 6A:
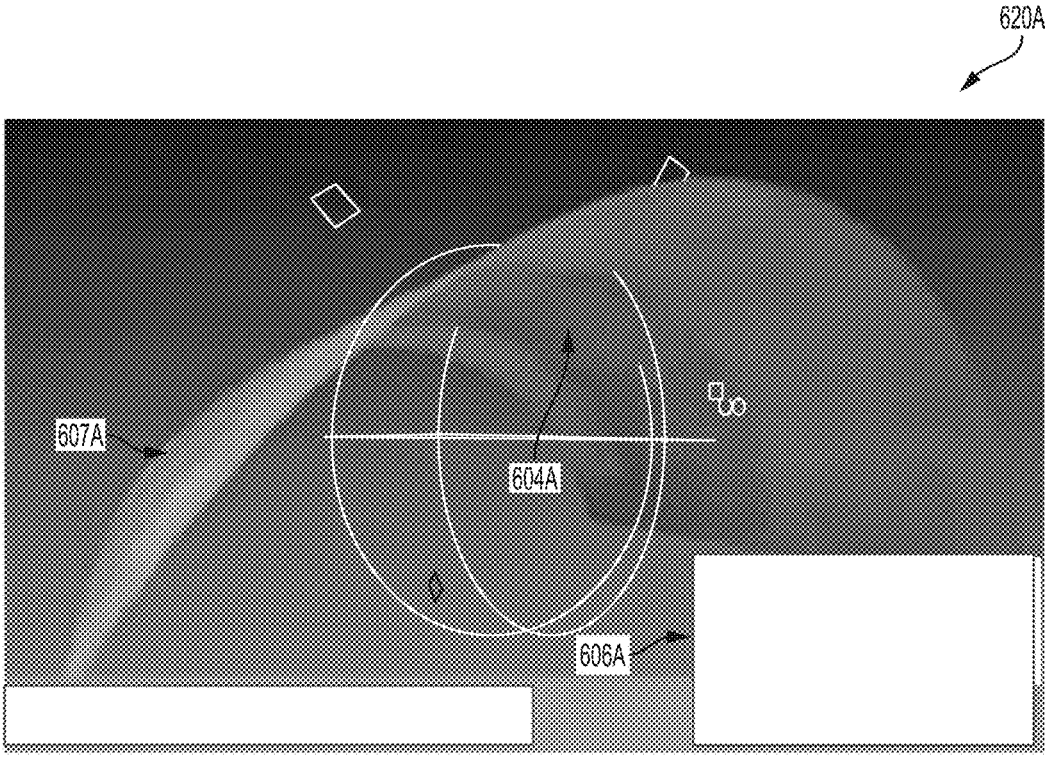
FIG. 6(A-B) illustrate example 3D graphical representations of conditions of pipe segments.
Figure 6B:
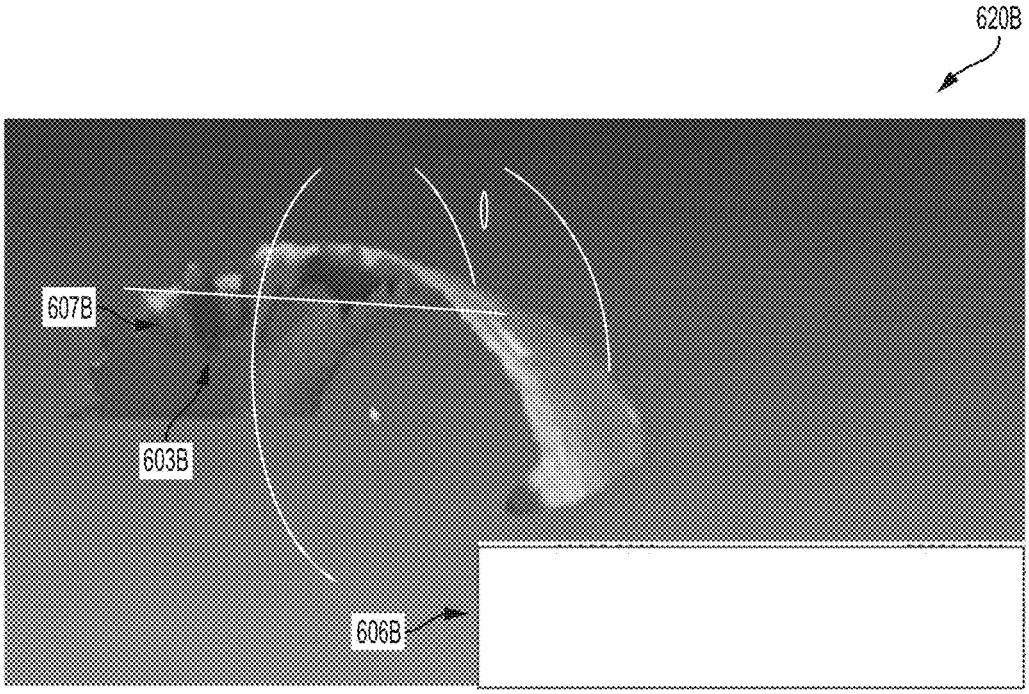

As illustrated in FIG. 6(A-B), using the data obtained by the pipe inspecting robot 110, 3D graphical representations 607A, 607B of pipe segments 620A, 620B allow the user to navigate through the selected pipe within its local environment. For example, in FIG. 6A, a given segment of pipe 620A may be graphically represented in 3D 607A such that a user can visually inspect an animated, 3D graphical representation 607A of the pipe segment 620A with corrosion 604A depicted, for example via use of color coding matched to a key graphic 606A. Similarly, FIG. 6B illustrates a given segment of pipe 620B that is graphically represented in 3D 607B such that a user can visually inspect an animated, 3D graphical representation 607B of the pipe segment 620B with sediment build up 603B depicted, for example via use of color coding matched to a key graphic 606A. Such 3D representations may be manipulated by the user, such as for example clicking and holding on the 3D representations 607A, 607B and rotating them, affording the user a full view of the condition of the pipe segment not available through standard CCTV imagery.

Figure 7A:
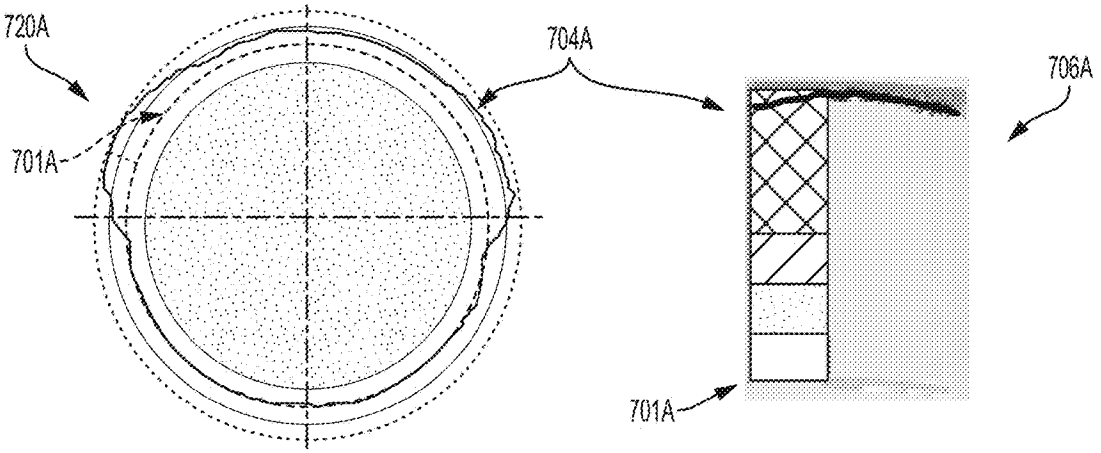
FIG. 7(A-B) illustrate example 2D graphical representations of conditions of pipe segments.
Figure 7B:
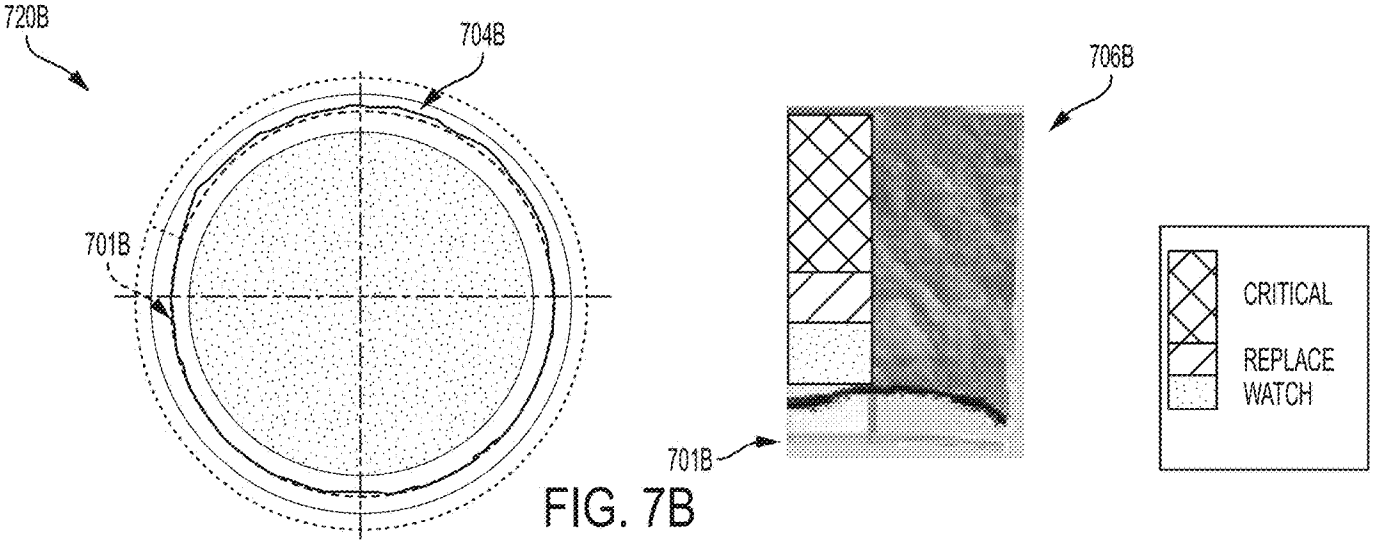

An embodiment provides various 2D graphical representations 720A, 720B of pipe cross sections as well. These may be either pinpointed cross sections (e.g. 1 millimeter segments) or averages of longer segments (e.g. 1 meter). Thus, in FIG. 7A, an embodiment provides a user with a 2D graphical representation 720A of a pipe cross-section exhibiting corrosion 704A, as compared with the expected internal face of the pipe 701A. This may be graphically represented in a depth chart display as well, along with a keyed graphic 706A (e.g. color coded) providing the user with relevant wall thickness depths and recommended actions given the particular pipe cross-section readings. FIG. 7B provides a contrast to FIG. 7A, wherein the pipe cross-section of FIG. 7B is relatively ideal when the actual diameter 704B is compared with the original diameter 701B in the graphical representation 720B. Thus, the key graphic 706B allows a user to quickly determine that this pipe segment of FIG. 7B is relatively healthy when compared to the standards of the key graphic 706B.

Figure 8:
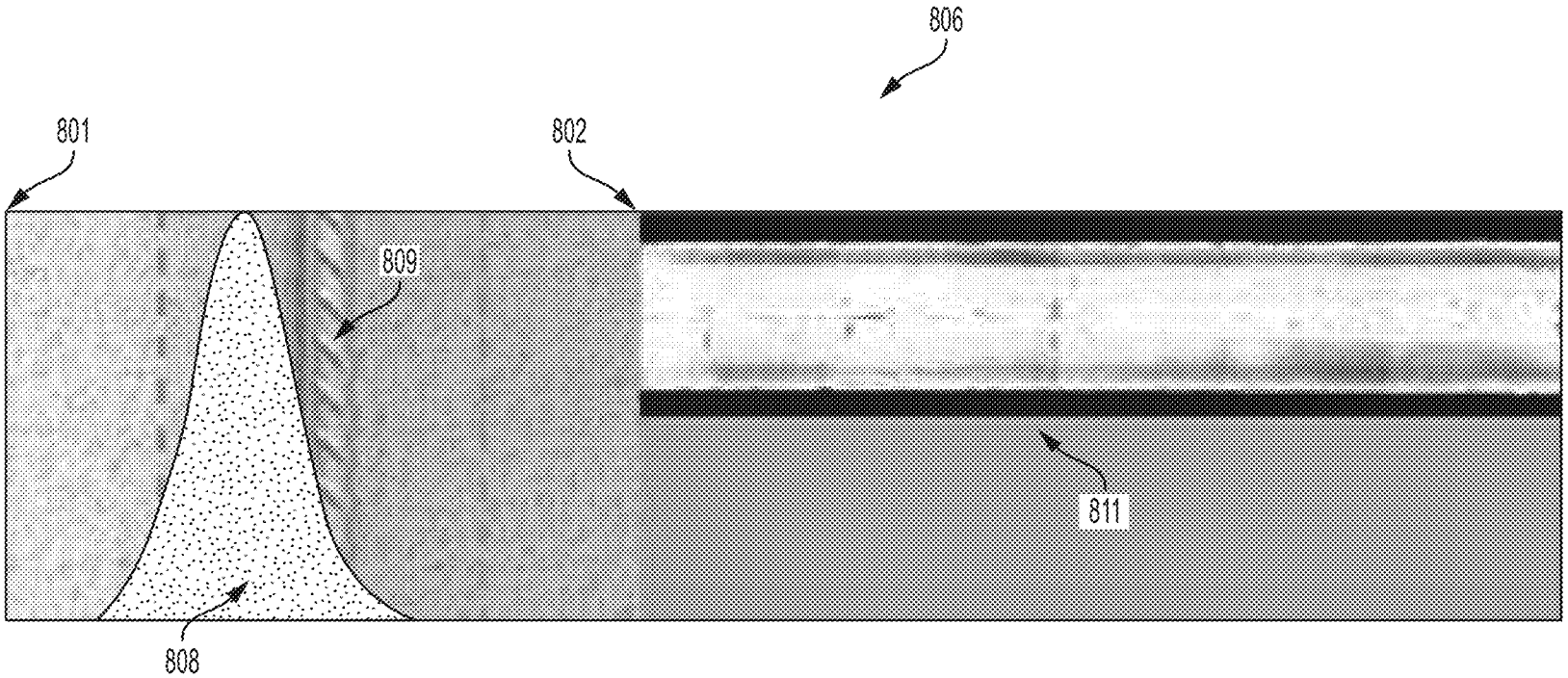
FIG. 8 illustrates an example 2D graphical representation of a condition of a pipe segment.

FIG. 8 illustrates a view provided by an embodiment wherein a graphic representation 806 of the pipe wall (internal face 801 and external face 802) and the Logan Distribution 808 for a particular pipe cross-section of interest is graphically illustrated along with a flat graph 811 for the particular segment. This view 806 provides both the Logan Distribution 808 view for the average values of the pipe segment, mapped or superimposed onto an illustrative pipe wall segment and showing that the pipe wall has corroded to a point near the rebar 809. The user is also provided with the corresponding flat graph 811 for easy reference and review.

Figure 9:
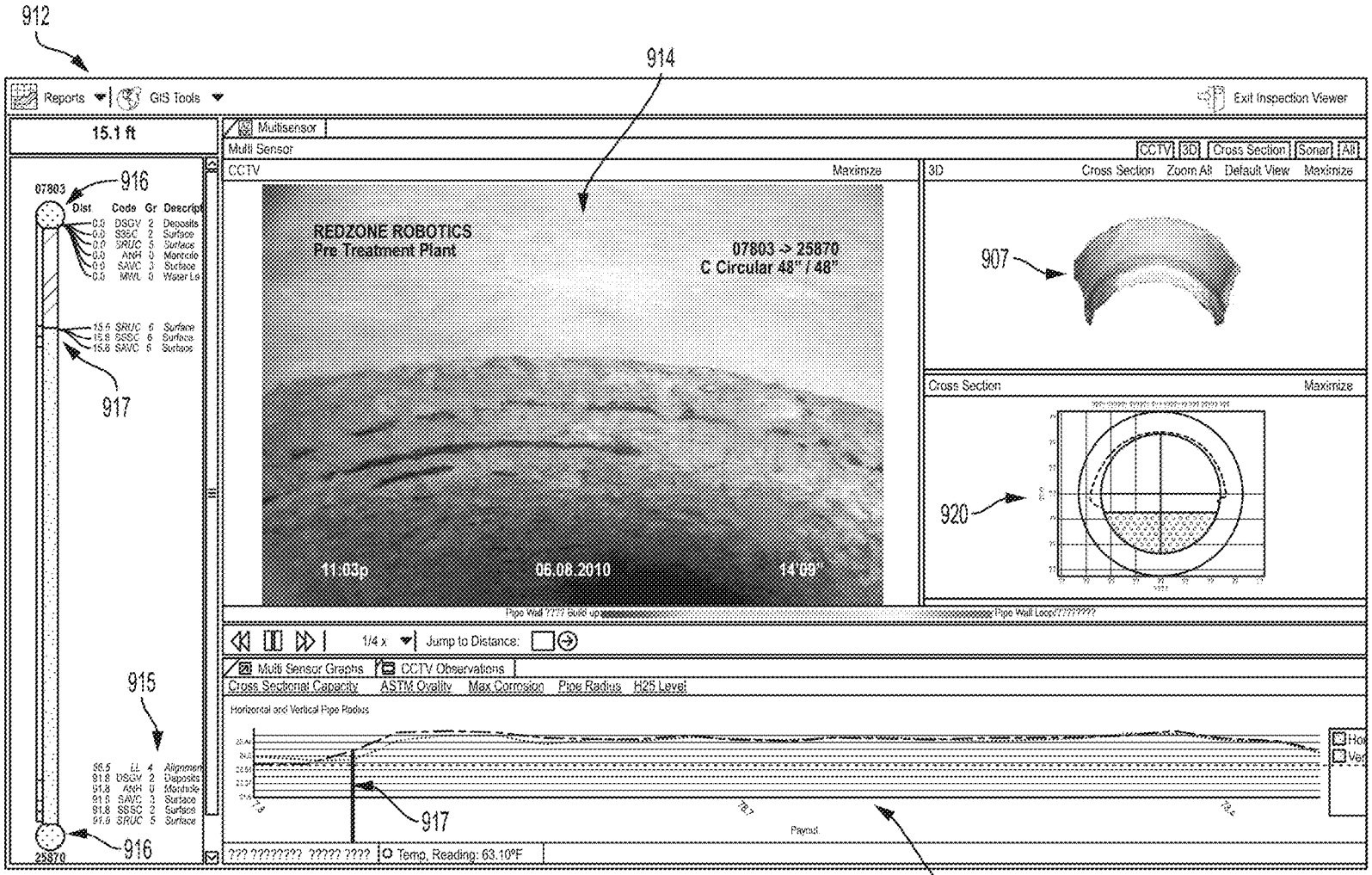
FIG. 9 illustrates an example view of a user interface having various graphical representations of a pipe segment.

An embodiment may combine the various data gathered by the data acquisition platform 110 in various user displays. For example, illustrated in FIG. 9 is a view 912 wherein a CCTV image 914 for a particular segment of pipe is provided. The segment of pipe for which data is loaded in this particular view 912 is provided in a left panel, i.e. between two manholes 916. The exact portion of the pipe segment being viewed currently is illustrated by an indicator 917, which provides easy reference to the user for understanding exactly which pipe segment portion the CCTV image was obtained from, due to synchronizing the pipe inspection robot's 110 data collection activities with a physical location with the pipe segment. The indicator 917 may be synchronized in several panels, for example in the lower panel (illustrating vertical and horizontal pipe diameters in X-Y graph form in this example). Moreover, the cross sectional graphic 920 and 3D graphic 907 are likewise synchronized with the portion of the pipe segment indicated by the indicator 917.

Figure 10:
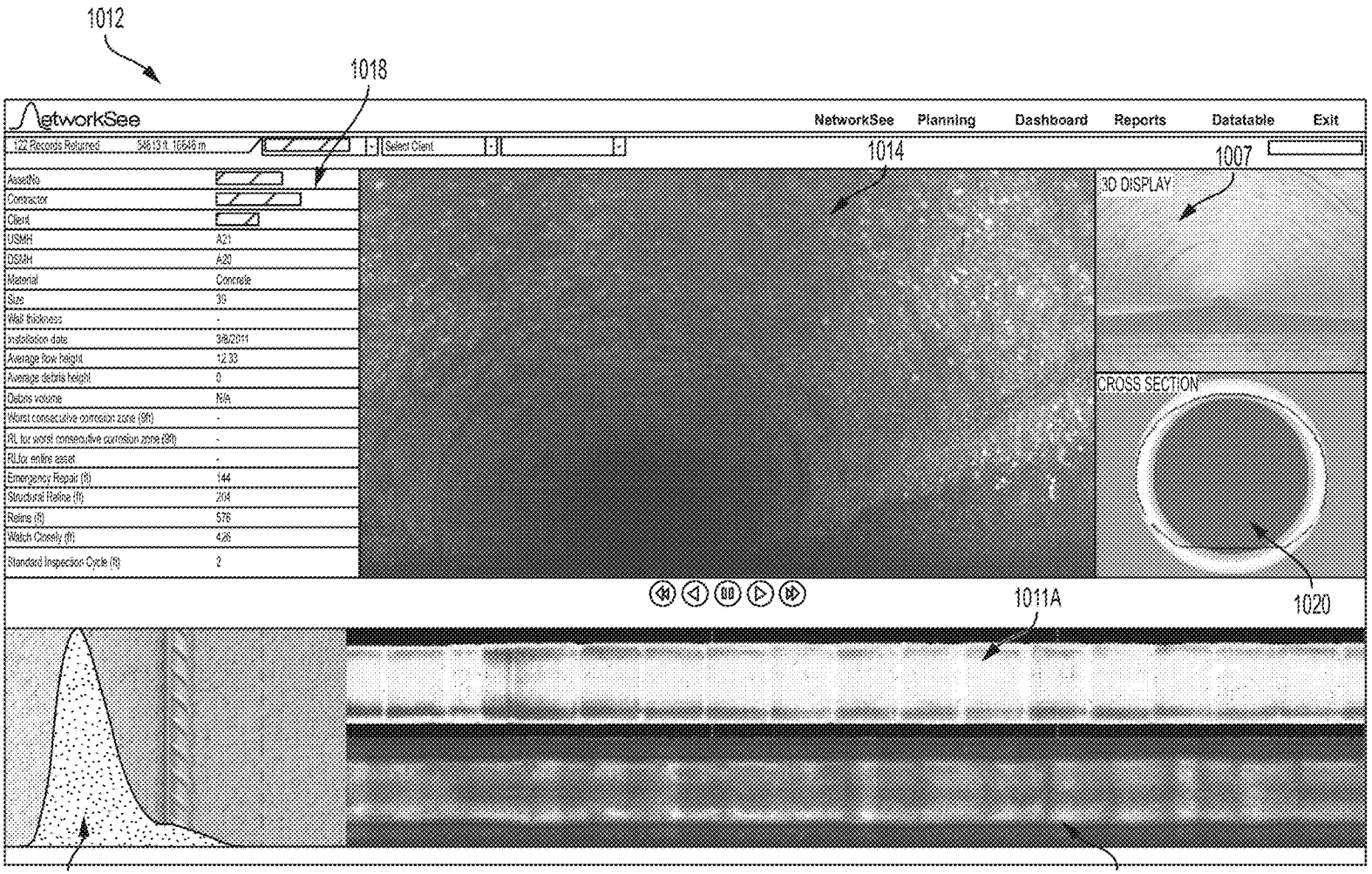
FIG. 10 illustrates an example view of a user interface having various graphical representations of a pipe segment.

As another example, FIG. 10 illustrates a view 1012 provided by an embodiment. Again a CCTV image 1014 may be synchronized with a pipe segment cross section 1020 and 3D graphical representation 1007. A Logan Distribution view 1008 is provided in a lower left panel of the view 1012, as well as the corresponding flat graphs 1011A, 1011B for the pipe segment that the Logan Distribution represents. Here, two flat graphs 1011A, 1011*b* are shown. One flat graph 1011A is a color coded flat graph (coded to illustrate corrosion levels) based on laser and/or sonar sensor data, and the other flat graph 1011B is CCTV data laid flat (in 2D).

Figure 11:
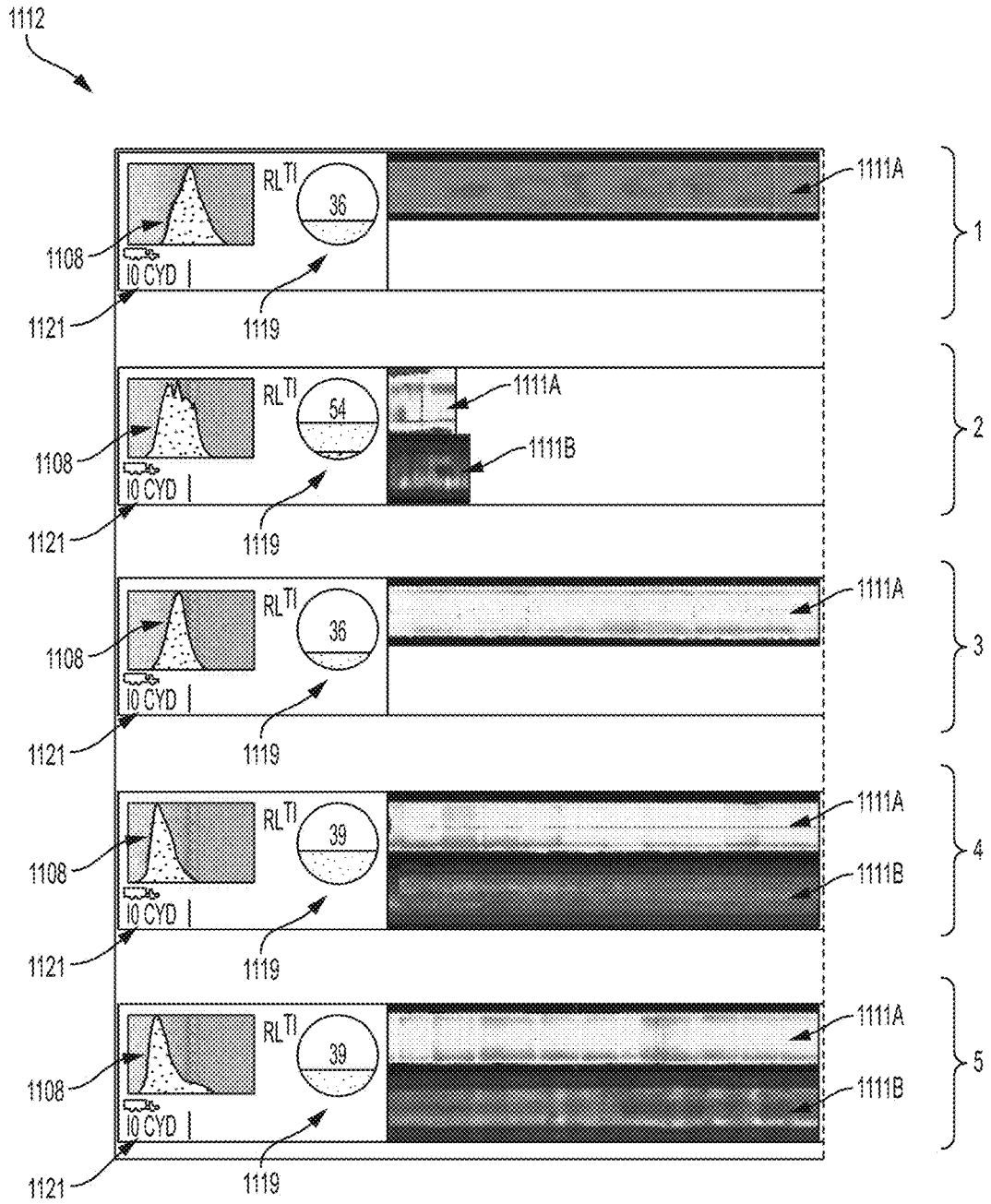
FIG. 11 illustrates an example view of a user interface having various graphical representations of pipe segments.

A view 1112 illustrated in FIG. 11 shows 5 different segments of pipe. A series of inspections of different pipe assets is sorted with the highest wall-loss peak from the Logan Distribution data to the lowest in this view 1112. The Logan Distribution 1108 for the asset on the top is past 50% wall loss. The pipe segments are sorted with lower wall loss peak levels descending (Logan Distribution 1108 peak farther to left on the graph). Rather than highest wall loss to lowest, the view 1112 may be sorted in different ways by the user. For example, the user may sort based on the location of the peak of the distribution (statistical mode), the mean of the distribution, the median of the distribution, or a variety of other calculated parameters describing the Logan Distribution 1108. Depending on the content of the Logan Distribution 1108, this would correlate to sorting for the "most corroded" pipes, the "most oval" pipes, or the pipes affected by sediment or debris. The user may also sort by other statistics unrelated to the Logan Distribution, such as pipe size, pipe material, etc.

Note that the distribution in view 1112 is accompanied by the flat graph representations 1111A and 1111B of the asset's laser/sonar sensor data (color or otherwise coded) and CCTV visual imagery collected from the inspection, respectively. Moreover, the view 1112 provides a representation of the volume of sediment in a given pipeline asset 1121 (represented by number of trucks), and a depiction of the pipe diameter (in this case variously 36", 39", and 54") within a graphic depiction of the water level and sediment level within the pipeline 1119.

The system can also use the Logan Distribution to analyze deviation from the reference in the form of corrosion and debris/sediment, which can be displayed as positive and negative variations (FIG. 4A). Again, the same positive and negative variation principle can be used for ovality in pipes.

These distribution graphs make it possible to quantify the current pipe condition and compare it with other pipes in a network, or historical records of the same pipe. Performing this analysis on the same pipe at different points in time provides useful information on the rate of deterioration. FIG. 4D illustrates an example of a Logan Curve for a network of pipes.

Figure 12:
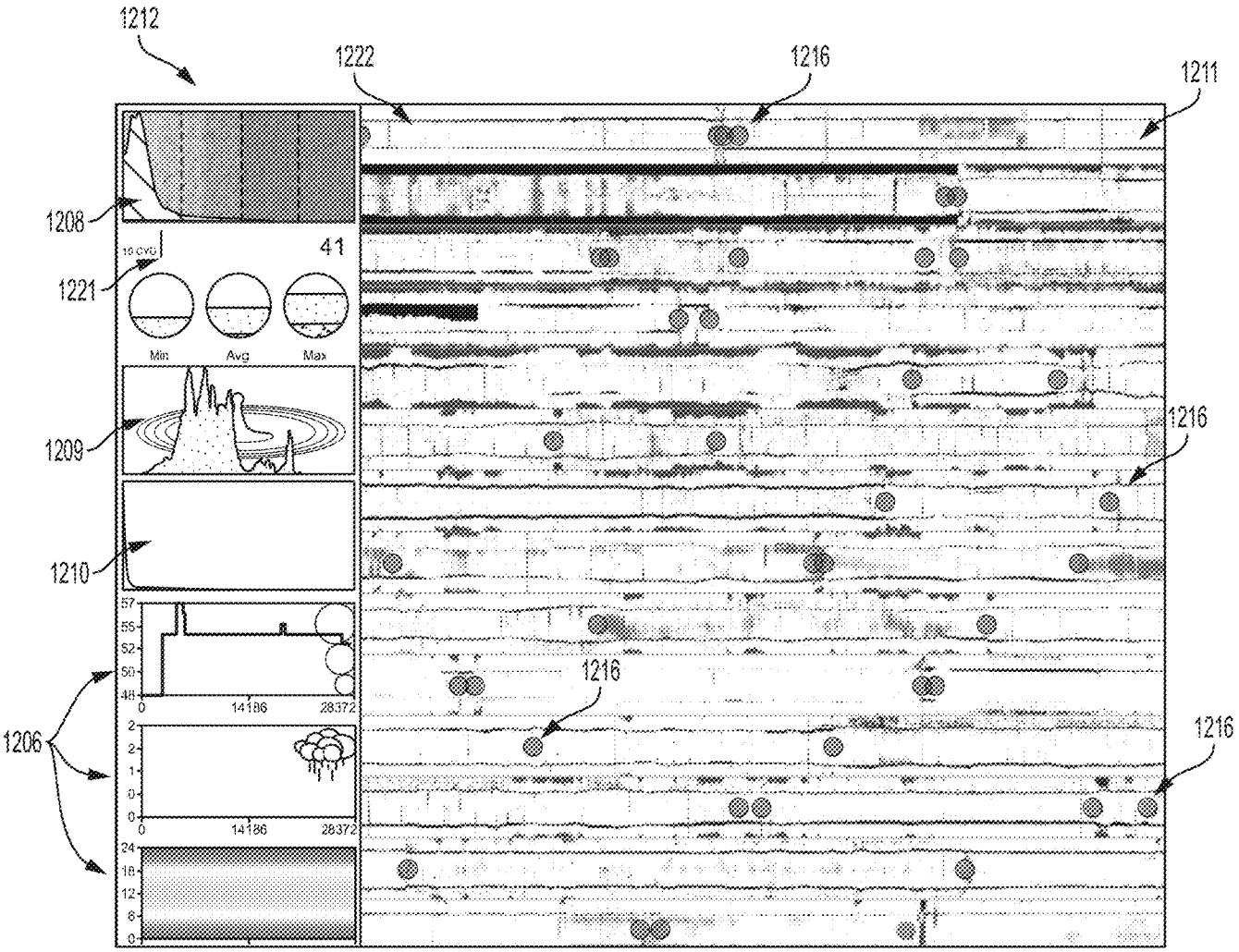
FIG. 12 illustrates an example view of a user interface having various graphical representations of pipe segments.

FIG. 12 illustrates a view 1212 of an entire portion of the pipe network. Instead of displaying a single pipeline asset's (defined for example as the portion of pipe between two manholes), consecutive pipeline assets' "flat" data are displayed from left to right like a book 1211. The circles 1216 represent manholes where one pipeline asset transitions to the next. The Logan Distribution 1208 in the top left is calculated for all points in the network (or relevant portion of the network) rather than solely for an individual asset (segment). The 'truck' graphic 1221 represents the total amount of sediment for this entire portion of the network (in this case, 41 trucks represents 410 cubic yards).

A Logan Distribution 1208 could be generated for any sensed and/or contextual data including but not limited to corrosion (as shown), sediment, ovality, water level, or other metrics for the relevant portions of a network. Examples of these are 1209 and 1210 showing water and sediment Logan Distributions respectively. Moreover, visual presentations (in the form of a graphic or numeric value, for example) may also be included in a graphic representation, for example pipe diameters, rain events, and the like 1206. The visual presentations 1206 may be in the form of a multidimensional graph. For example, in the top panel of 1206, a pipe diameter multidimensional graph is illustrated, for example having pipe length of pipe on the x axis and pipe diameter on the y-axis derived from sensed data, matching the flat graph 1211 portion of pipe network in the graphical representation. In the middle panel of the visual presentations 1206, a multidimensional graph is illustrated for rain events, for example having length of pipe on the x axis and water level on the y-axis, with rain event (times) indicated by an icon—for example a cloud icon, again matched to the sensed pipe data of the flat graph portion 1211. Similarly, visual presentation 1206 in the lower panel may include a time of day in which the measurement was taken, again as plotted against length of pipe on the x axis and time on the y-axis, which also is matched to the sensed data of the flat graph portion 1211.

The system can also use the Logan Distribution 1208 to estimate the time until a section of pipe will reach a certain level of degradation (time series estimation, FIG. 4C-D). The rate of movement to the right in successive Logan Distribution graphs, FIG. 4C, combined with industry accepted courses of action at various deterioration levels, allows for planning and estimated cost to repair versus time not rehabilitated.

For example, intuitively, if the actual corrosion levels in a pipeline are known (e.g. a 30% corrosion according to the mean of the Logan Distribution or the 95th percentile of the Logan Distribution), and the rate of corrosion is known (e.g. 5% per year), an embodiment may calculate the time until the corrosion reaches a certain threshold indicating failure. Failure could be defined as desired, for example as 100% where the wall is completely corroded away, at 50% where the rebar is exposed and begins to deteriorate, or some other threshold. This can be used to calculate an estimated remaining useful life of a pipe segment or a network of pipes. The Logan Curve enables calculation of the rate of corrosion specifically by pipe type, locality or any other contextual or sensed data as illustrated in FIG. 4D. This ability to predict remaining useful life of a pipe with specific rate of corrosion estimates from the same locality is a salient feature of the embodiments.

Figure 13:
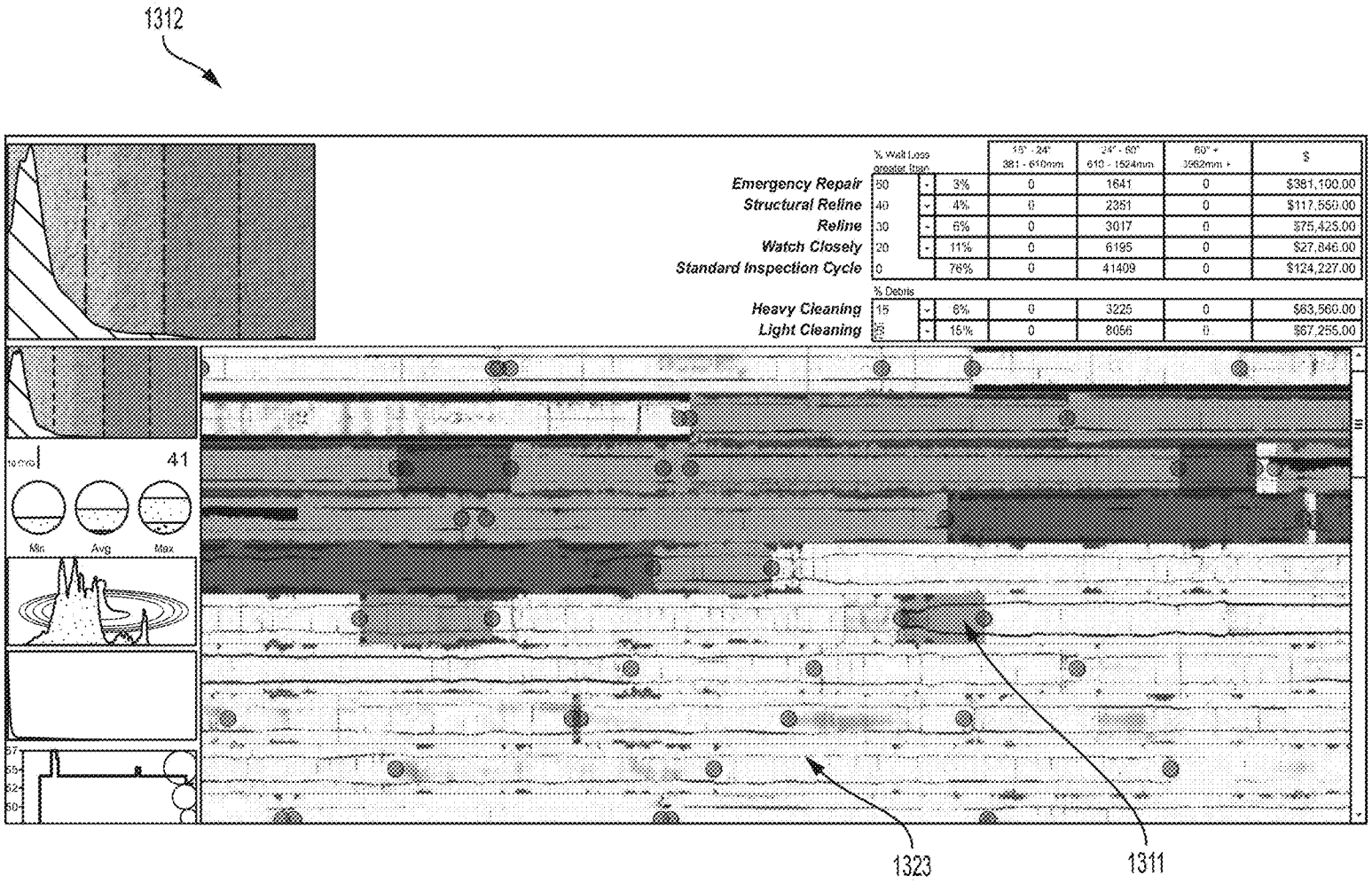
FIG. 13 illustrates an example view of a user interface having various graphical representations of pipe segments with portions thereof selected.
Figure 14:
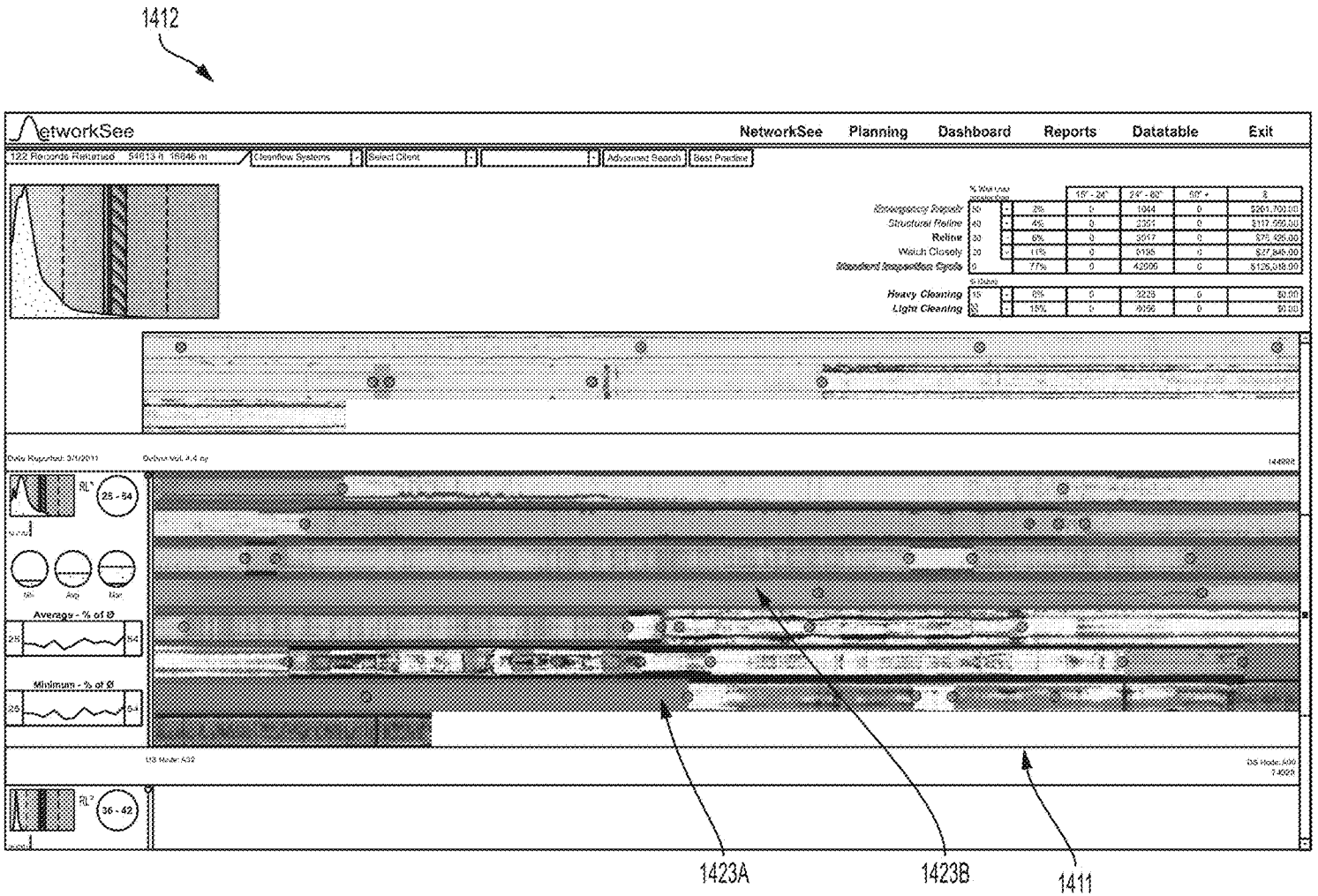
FIG. 14 illustrates an example view of a user interface having various graphical representations of pipe segments with portions thereof selected.
Figure 15:
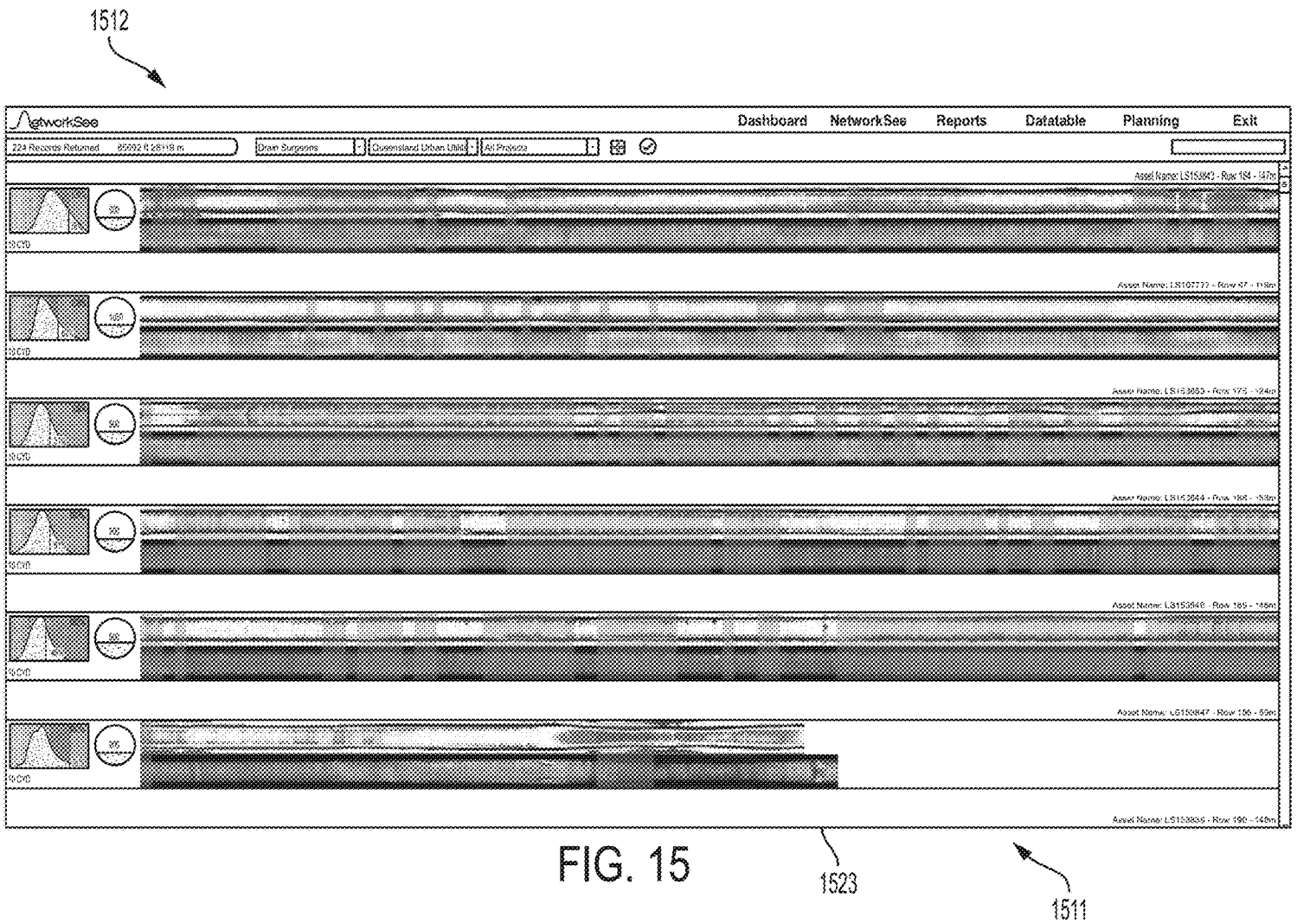
FIG. 15 illustrates an example view of a user interface having various graphical representations of pipe segments with portions thereof selected.
Figure 16:
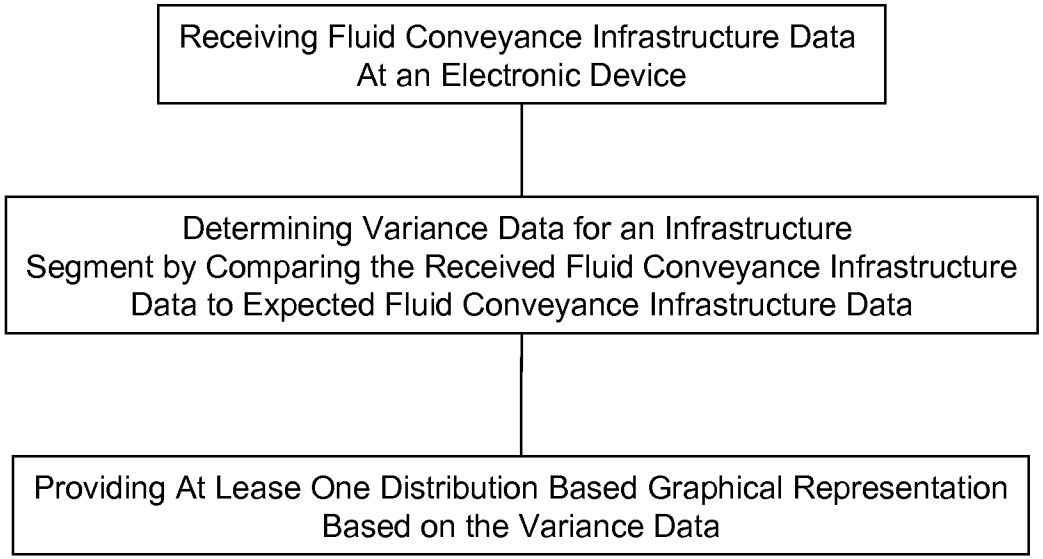
FIG. 16 illustrates a method according to an embodiment.

FIG. 13 through FIG. 15 illustrate examples of highlighting or selecting portions of a flat graph. For example, a user may highlight a portion of a flat graph 1311 showing portions 1323 of the infrastructure that meet certain thresholds with regard to cross-sectional area loss. For the example illustrated in FIG. 13, portions of the infrastructure with less than 5% loss of cross-sectional area are not highlighted, those with greater than 15% are highlighted in dark, and those in between are in lightly highlighted. An asset manager could use this information to determine which areas of the infrastructure need to be cleaned using heavy cleaning or light cleaning techniques, for example. The thresholds used for highlighting could be modified.

The amount of linear footage of infrastructure included in these highlighted areas may be calculated, along with the total volume of sediment in these areas, and even an expected cost for performing the heavy cleaning or light cleaning in these areas. The highlighting 1323 and calculations may be presented to the user in a graphical display illustrated for example in the view of 1312.

A similar example showing a highlighting or selecting concept is illustrated in FIG. 14. In the view 1412 of FIG. 14, various different shadings or color-codes 1423A, 1423B in the flat graph 1411 may be presented based on the levels of corrosion. In this case, different thresholds of wall loss percentage (again user-adjustable) map to different repair or rehabilitation strategies that could be taken. A linear footage for each category again may be calculated and a budgeted cost calculated and provided to a user.

Referring to FIG. 15, an embodiment provides for querying the system to generate reports. Generally, this querying of the infrastructure may be done on a variety of metrics such as corrosion levels, ovality levels, sediment levels, water levels, or other calculated metrics. The querying can classify the infrastructure into different categories, and each category can be color coded showing which portions 1523 of the infrastructure in the flat graph 1511 belong to the chosen category. Each category may be summed (e.g. in terms of linear footage included in the category) and metrics may be calculated summarizing the infrastructure in each category (e.g. average wall loss, total sediment volume, etc.). These categories could be mapped to actions, for example cleaning or rehabilitation and a cost to perform those actions may be calculated.

This querying can be done on metrics such as wall loss or cross-sectional area loss, or they can be done on calculated metrics from the segment data. One such example is calculating the ovality at each cross-section, or the ratio between the vertical and horizontal dimensions of a circular cross-section. The data may be queried for other calculated metrics, including mathematical signatures of various pipe condition phenomenon. For example, these signatures may be queried relative to pipe conditions such as locations where a cross-sectional area loss is leading to a rise in water level. These locations would be candidates for cleaning to remove the water level buildup. The signatures may be queried relative to sags or depressions in a pipe (localized reduction in slope), which could be found by looking for changes in water level that are not accompanied by sediment or debris buildup in the vicinity. These signatures could be queried relative to locations where a buildup in debris or sediment is accompanied by a localized increase in corrosion. These could be areas where build up of sediment is releasing $H_2S$ gas and causing corrosion in that specific location.

In this regard, FIG. 15 illustrates a view 1512 of an example dynamic querying interface where the user sets a threshold directly on the Logan Distribution and all portions of infrastructure within this threshold (in this case, to the right of the line on the Logan curve) are highlighted. Once a particular portion of the infrastructure is identified of being of interest, the user can open the inspection data directly and see the sensed data in a variety of formats (FIG. 9, FIG. 10). The user can navigate and jump to specific locations in the flat graph 1511, play the video normally or at a variety of speeds, for example via moving an indicator 917, or the user may query for certain conditions or observations and jump directly there.

It will be readily understood that certain embodiments can be implemented using any of a wide variety of devices or combinations of devices. An example device that may be used in implementing one of more embodiments includes a computing device included for example in the data acquisition platform as described in commonly assigned U.S. patent application Ser. No. 13/654,380, issued as U.S. Pat. No. 9,183,527 and entitled "ANALYZING INFRASTRUCTURE DATA", filed on Oct. 17, 2012, which is incorporated by reference herein in its entirety. Other devices, including a remote device in communication with the data acquisition platform, may be utilized. In this regard, the computer may execute program instructions configured to store and analyze infrastructure data, including infrastructure and pipe segment data, and the like, and perform other functionality of the embodiments, as described herein.

Components of computer may include, but are not limited to, a processing unit, a system memory, and a system bus that couples various system components including the system memory to the processing unit. The computer may include or have access to a variety of computer readable media. The system memory may include computer readable storage media in the form of volatile and/or nonvolatile memory such as read only memory (ROM) and/or random access memory (RAM). By way of example, and not limitation, system memory may also include an operating system, application programs, other program modules, and program data.

A user can interface with (for example, enter commands and information) the computer through input devices. A monitor or other type of device can also be connected to the system bus via an interface, such as an output interface. In addition to a monitor, computers may also include other peripheral output devices. The computer may operate in a networked or distributed environment using logical connections to one or more other remote computers or databases. The logical connections may include a network, such local area network (LAN) or a wide area network (WAN), but may also include other networks/buses.

It should be noted as well that certain embodiments may be implemented as a system, method or computer program product. Accordingly, aspects may take the form of an entirely hardware embodiment, an entirely software embodiment (including firmware, resident software, micro-code, et cetera) or an embodiment combining software and hardware aspects that may all generally be referred to herein as a "circuit," "module" or "system." Furthermore, aspects may take the form of a computer program product embodied in one or more computer readable medium(s) having computer readable program code embodied therewith.

Any combination of one or more computer readable storage medium(s) may be utilized. A computer readable storage medium may be, for example, but not limited to, an electronic, magnetic, optical, electromagnetic, infrared, or semiconductor system, apparatus, or device, or any suitable combination of the foregoing. More specific examples of the computer readable storage medium would include the following: a portable computer diskette or memory stick, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible, non-signal storage medium that can contain or store a program for use by or in connection with an instruction execution system, apparatus, or device.

Computer program code may be propagated by data signal for transmission between devices. Such a propagated signal may take any of a variety of forms, including, but not limited to, electro-magnetic, optical, or any suitable combination thereof. Program code embodied on a computer readable storage medium thus may be transmitted using any appropriate medium, including but not limited to wireless, wireline, optical fiber cable, RF, et cetera, or any suitable combination of the foregoing.

Computer program code for carrying out operations for various aspects may be written in any combination of one or more programming languages. The program code may execute entirely on a single computer (device), partly on a single computer, as a stand-alone software package, partly on single computer and partly on a remote computer or entirely on a remote computer or server. In the latter scenario, the remote computer may be connected to another computer through any type of network, including a local area network (LAN) or a wide area network (WAN), or the connection may be made for example through the Internet using an Internet Service Provider.

It will be understood that various functionality described herein may be implemented by computer program instructions. These computer program instructions may be provided to a processor of a device to produce a machine, such that the instructions, which execute via the processor create means for implementing the functions/acts specified.

These computer program instructions may also be stored in a computer readable storage medium that can direct a device to function in a particular manner, such that the instructions stored in the computer readable storage medium produce an article of manufacture including instructions which implement the function/act specified.

The computer program instructions may also be loaded onto a device to cause a series of operational steps to be performed on the device to produce a device implemented process such that the instructions which execute on the device provide processes for implementing the functions/acts specified.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Although illustrated example embodiments have been described herein with reference to the accompanying drawings, it is to be understood that embodiments are not limited to those precise example embodiments, and that various other changes and modifications may be affected therein by one skilled in the art without departing from the scope or spirit of the disclosure.

What is claimed is:

1. A method for collecting pipe measurement data and graphically representing a condition of a pipe, comprising:

obtaining, with an inspection robot that traverses through an interior of a water or sewer pipe, in-situ measurement data comprising one or more of laser measurement data and sonar measurement data, the measurement data comprising a series of radial measurements of the interior of the pipe;

receiving the measurement data at an electronic device;

determining, using the electronic device, variance data for a length of the water or sewer pipe by comparing the received measurement data to ideal pipe data;

accumulating, using the electronic device, the variance data into one or more variance bins to produce variance bin values; and displaying, using an electronic device comprising a display screen and a processor, a cross-section graphic on the display screen, the cross-section graphic being based on the variance bin values and summarizing the variance data for the length of the pipe;

wherein the cross-section graphic comprises a distribution curve graphic that is superimposed directly on top of an ideal pipe graphic, the ideal pipe graphic comprising an interior and exterior wall of an ideal pipe wherein the distribution curve graphic is mapped to a position on the ideal pipe graphic representative of the variance data for the entire length of the pipe.

2. The method of claim 1, wherein the variance data is determined by:

comparing a plurality of received pipe data points with a corresponding plurality of expected pipe data points.

3. The method of claim 2, wherein the plurality of received pipe data points are measurement data points representative of pipe cross-sectional dimension at different points along the length of the water or sewer pipe.

4. The method of claim 1, further comprising providing at least one three-dimensional representation based on the variance data.

5. The method of claim 1, further comprising, for a distribution of one or more of positive and negative variance points that exceeds a threshold variance, automatically indicating a predetermined rehabilitation.

6. The method of claim 1, further comprising: calculating, using the variance data, an estimated time until a pipe segment reaches a predetermined level of degradation.

7. The method of claim 6, wherein the calculating is further based on industry standards.

8. A method for collecting pipe measurements and graphically representing a condition of a pipe, comprising:

receiving in situ measurements from a pipe inspection robot that repeatedly measures, using one or more of a laser measurement device or a sonar measurement device, a distance to an interior wall of a water or sewer pipe as the pipe inspection robot traverses through an interior of the water or sewer pipe in a longitudinal direction;

for each measurement position within the water or sewer pipe, determining variance data by comparing one or more measured distance values to reference data;

accumulating the variance data for the measurement positions into one or more variance bins to produce variance bin values; and displaying, using a computing device comprising a display screen and a processor, a graphic comprising:

a distribution curve graphic based on the variance bin values plotted along an axis representing the one or more variance bins ordered according to variance from the reference data; and a cross-sectional graphic of an expected wall thickness of an ideal pipe comprising an interior and exterior wall of the ideal pipe;

wherein the graphic comprises the distribution curve graphic superimposed directly on top of the cross-sectional graphic and provides a summary of the variance data for the longitudinal length of the water or sewer pipe with respect to the reference data.

9. A method for collecting pipe measurement data and graphically representing a condition of a pipe, comprising:

traversing, using a pipe inspection robot, through an interior of a water or sewer pipe;

obtaining, using one or more of a laser module and a sonar module of the pipe inspection robot, in situ measurement data representing a distance between the one or more of the laser module and the sonar module and an interior surface of the water or sewer pipe;

determining, for a longitudinal length of the water or sewer pipe, cumulative variance data from the measurement data and ideal pipe reference data;

the cumulative variance data comprising a distribution curve graphic of variance from the ideal pipe reference data; and providing, using a computing device comprising a display screen and a processor, a cross-section graphic displayed on the display screen in a user interface, the cross-section graphic comprising the distribution curve graphic and an ideal pipe graphic;

wherein the distribution curve graphic is positioned in the cross-section graphic by superimposing the distribution curve graphic directly on top of the ideal pipe graphic in the cross-section graphic with respect to an interior and an exterior wall of the ideal pipe graphic in the cross-section graphic based on the variance data for the longitudinal length of the water or sewer pipe; and wherein the positioning of the distribution curve graphic summarizes the variance data for the entire longitudinal length of the water or sewer pipe.

10. The method of claim 9, wherein the pipe inspection robot comprises a floating raft; and wherein the sonar module acts to obtain measurement data beneath the floating raft in the water or sewer pipe.

11. The method of claim 9, comprising:

determining, from the variance data, a number of truckloads of sediment contained within the water or sewer pipe; and displaying one or more truck graphics in a display comprising the cross-section graphic.

12. The method of claim 9, comprising calculating, using the variance data, an estimated time until a pipe segment reaches a predetermined level of degradation.

* * * * *